US008339427B2

(12) United States Patent
Shirasaki et al.

(10) Patent No.: US 8,339,427 B2
(45) Date of Patent: Dec. 25, 2012

(54) DISPLAY DRIVE APPARATUS AND DISPLAY APPARATUS

(75) Inventors: Tomoyuki Shirasaki, Higashiyamato (JP); Jun Ogura, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 135 days.

(21) Appl. No.: 13/027,729

(22) Filed: Feb. 15, 2011

(65) Prior Publication Data

US 2011/0134166 A1 Jun. 9, 2011

Related U.S. Application Data

(63) Continuation of application No. 11/888,474, filed on Aug. 1, 2007, now Pat. No. 7,969,398.

(30) Foreign Application Priority Data

Aug. 1, 2006 (JP) ..... 2006-209534
Aug. 10, 2006 (JP) ..... 2006-218805

(51) Int. Cl.
*G09G 5/10* (2006.01)

(52) U.S. Cl. ..... 345/690; 345/76; 345/89

(58) Field of Classification Search ..... 345/76–83, 345/87–100, 204–215, 690
See application file for complete search history.

(56) References Cited

U.S. PATENT DOCUMENTS 7,046,240 B2 * 5/2006 Kimura ..... 345/212
7,561,147 B2 7/2009 Tsuge
7,583,261 B2 9/2009 Shirasaki et al.
7,719,492 B2 5/2010 Childs
7,969,398 B2 * 6/2011 Shirasaki et al. ..... 345/89
2004/0239596 A1 12/2004 Ono et al.
2004/0246212 A1 12/2004 Kobayashi et al.
2005/0030264 A1 2/2005 Tsuge et al.
2005/0041002 A1 2/2005 Takahara et al.
2005/0057580 A1 3/2005 Yamano et al.
2006/0221015 A1 10/2006 Shirasaki et al.
2007/0146251 A1 6/2007 Tsuge et al.
2008/0191976 A1 8/2008 Nathan et al.

(Continued)

FOREIGN PATENT DOCUMENTS

CN 1552052 A 12/2004

(Continued)

OTHER PUBLICATIONS

Japanese Office Action dated Jun. 11, 2008, and English translation thereof, issued in counterpart Japanese Application No. 2006-218805.

(Continued)

*Primary Examiner* — Vijay Shankar
(74) *Attorney, Agent, or Firm* — Holtz, Holtz, Goodman & Chick, PC

(57) ABSTRACT

A display pixel including a light-emitting element and a drive element for supplying current flowing in a current path to the light-emitting element is applied with a detection voltage based on a predetermined unit voltage. Based on a value of current flowing in the current path of the drive element, a specific value corresponding to an element characteristic of the drive element is detected. A gradation voltage corresponding to a luminance gradation of display data is generated. Based on the specific value and the unit voltage, a compensated voltage is generated. By compensating the gradation voltage based on the compensated voltage, a compensated gradation voltage is generated. And the compensated gradation voltage is supplied to the display pixel.

8 Claims, 16 Drawing Sheets

U.S. PATENT DOCUMENTS

| | | | |
|---|---|---|---|
| 2008/0225027 | A1 | 9/2008 | Toyomura et al. |
| 2008/0238953 | A1 | 10/2008 | Ogura |
| 2009/0189924 | A1 | 7/2009 | Ogura |
| 2009/0201231 | A1 | 8/2009 | Takahara et al. |
| 2009/0207160 | A1 | 8/2009 | Shirasaki et al. |

FOREIGN PATENT DOCUMENTS

| | | | |
|---|---|---|---|
| EP | 1 434 193 | A1 | 6/2004 |
| JP | 8-330600 | A | 12/1996 |
| JP | 2001-147659 | A | 5/2001 |
| JP | 2003-195810 | A | 7/2003 |
| JP | 2004-004675 | A | 1/2004 |
| JP | 2004-021219 | A | 1/2004 |
| JP | 2004-252110 | A | 9/2004 |
| JP | 2005-115144 | A | 4/2005 |
| JP | 2006-119180 | A | 5/2006 |
| JP | 2006-178028 | A | 7/2006 |
| JP | 2006-195477 | A | 7/2006 |
| JP | 2007-519956 | T | 7/2007 |
| JP | 2008-504576 | T | 2/2008 |
| KR | 10-2003-0032530 | A | 4/2003 |
| KR | 2003-0078741 | A | 10/2003 |
| KR | 10-2004-0041620 | A | 5/2004 |

OTHER PUBLICATIONS

Korean Office Action dated Aug. 31, 2009, and English translation thereof, issued in counterpart Korean Application No. 10-2007-0077017.

International Preliminary Report on Patentability and Written Opinion dated Aug. 29, 2009, issued in counterpart International Application No. PCT/JP2006/307283.

Chinese Office Action dated Nov. 7, 2008, and English translation thereof, issued in counterpart Chinese Application No. 2006800004519.

U.S. Appl. No. 11/391,941, filed Mar. 29, 2006, which is related to U.S. Appl. No. 11/888,474, filed Aug. 1, 2007, of which the present application is a Continuation.

Japanese Office Action dated Apr. 22, 2010, and English translation thereof, issued in Japanese Application No. 2005-101905, which is a counterpart of related U.S. Appl. No. 11/391,941.

Japanese Office Action dated Apr. 22, 2010, and English translation thereof, issued in Japanese Application No. 2005-105373, which is a counterpart of related U.S Appl. No. 11/391,941.

* cited by examiner

DISPLAY DRIVE APPARATUS AND DISPLAY APPARATUS

This is a Continuation of U.S. application Ser. No. 11/888,474, filed Aug. 1, 2007 now U.S. Pat. No. 7,969,398, which is based upon and claims the benefit of priority from prior Japanese Patent Application No. 2006-209534, filed Aug. 1, 2006, and Japanese Patent Application No. 2006-218805, filed Aug. 10, 2006, the entire contents of all of which are incorporated herein by reference.

BACKGROUND OF THE INVENTION

1. Field of the Invention

The present invention relates to a display drive apparatus and a drive method thereof, and a display apparatus and the drive method thereof. In particular, the present invention relates to a display drive apparatus for drive a display pixel including a light-emitting element that emits light by receiving current, and a display apparatus including a display panel in which the display pixels are arranged in a plurality of rows that display image information and the drive method thereof.

2. Description of the Related Art

In recent years, a self light emitting-type display apparatus has been actively researched and developed as a next-generation display device following a liquid crystal display apparatus. A self light emitting-type display apparatus includes a display panel in which organic electroluminescence elements (organic EL elements), inorganic electroluminescence elements (inorganic EL elements), or elements such as light-emitting diode (LED) for example are arranged in a matrix-like manner.

When a self light emitting-type display using an active matrix drive method in particular is compared with a well-known liquid crystal display apparatus, this self light emitting-type display has a higher display response speed, a lower view angle dependence, as well as higher brightness, higher contrast, and image quality with higher definition and does not require, in contrast with a liquid crystal display apparatus, a backlight or a light guide plate. Thus, this self light emitting-type display using an active matrix drive method is very advantageous in having a further thinner thickness and a lighter weight. Thus, this self light emitting-type display is expected to be applied to various electronic devices in the future.

The self light emitting-type display using the active matrix drive method comprises, with regards to every display pixel, a light-emitting element and a pixel drive circuit structured to include a plurality of switching elements (transistors) for controlling the light-emitting status of the light-emitting element for example.

A gradation control method for this display pixel is mainly classified to a current-writing method and a voltage-writing method. In the current-writing method, gradation current having a current value in accordance with display data is supplied to a display pixel and a voltage component in accordance with a current value of gradation current is held in a pixel drive circuit to flow, based on the held voltage, drive current through a light-emitting element to control a light-emitting brightness. In the voltage-writing method, a gradation voltage having a value in accordance with display data is supplied to a display pixel to hold, in a pixel drive circuit, a voltage component corresponding to current flowing in accordance with the supplied gradation voltage to flow a drive current based on the held voltage component through a light-emitting element to control a light-emitting brightness.

The current-writing method can suppress, even when variation or dispersion of characteristics of a switching element of a pixel drive circuit is caused, an influence on drive current supplied to a light-emitting element and thus can realize a light-emitting operation with appropriate brightness and gradation in accordance with display data for a long period of time and in a stable manner. However, the current-writing method may cause a case where, when gradation current in accordance with display data having the lowest or relatively-low brightness is written to the respective display pixels, a writing time constant causes an increased time for charging a data line to cause a longer writing operation to prevent a previously-set writing time from providing a sufficient writing operation to cause a so-called insufficient writing to cause a deteriorated quality of a displayed image.

The voltage-writing method on the other hand can suppress the insufficient writing because current flowing when a gradation voltage is supplied to a display pixel can be increased. However, variation in characteristics of a switching element of a pixel drive circuit causes variation in a value of current flowing during a writing operation to cause variation in a voltage component held by a pixel drive circuit to cause variation in a value of a drive current flowing through a light-emitting element.

SUMMARY OF THE INVENTION

The present invention is advantageous in that a display drive apparatus which drives a display pixel including light-emitting elements and a display apparatus including the display drive apparatus can suppressed from causing an insufficient writing and can compensate a variation in characteristics of a drive element of a display pixel to allow the light-emitting elements to emit, for a long period of time, light with brightness suitable for a luminance gradation of display data.

In order to obtain the above advantage, the display drive apparatus of the present invention is a display drive apparatus which drives a display pixel including a light-emitting element and a drive element connected to the light-emitting element, comprising:

a specific value detection circuit which detects a specific value corresponding to an element characteristic of the drive element based on a value of current flowing in a current path of the drive element when a detection voltage based on a predetermined unit voltage is applied to the display pixel; and a gradation voltage compensation circuit which generates a compensated gradation voltage by compensating a gradation voltage based on the compensated voltage, and applies the compensated gradation voltage to the display pixel, said gradation voltage corresponding to a luminance gradation of the display pixel designated by display data, and said compensated voltage being generated based on the specific value detected by the specific value detection circuit and the unit voltage.

In order to obtain the above advantage, the first display apparatus of the present invention is a display apparatus which displays image information in accordance with display data, comprising:

a display panel in which, in the vicinity of the respective intersection points of a plurality of selection lines and data lines arranged in a row direction and a column direction, a plurality of display pixels are arranged, each of the display pixels including a light-emitting element and a drive element for flowing current through a current path of the light-emitting element;

a selection drive section which sequentially applies, a selection signal to the respective plurality of selection lines to sequentially set the display pixels in the respective rows to a selected status; and a data drive section which generates a gradation signal in accordance with the display data and supply the gradation signal to the respective display pixels in a row set to the selected status via the respective data lines, wherein:

the data drive section comprises:

a specific value detection circuit which detects, when a detection voltage based on a predetermined unit voltage is applied to the respective display pixels via the respective data lines, specific values corresponding to element characteristics of the drive elements of the respective plurality of display pixels based on values of currents flowing in current paths of the drive elements of the respective display pixels; and a gradation voltage compensation circuit which generates a compensated gradation voltage by compensating a gradation voltage based on a compensated voltage and supplies the generated compensated gradation voltage as the gradation signal to the respective display pixels via the respective data lines, the gradation voltage corresponding to a luminance gradation indicated by display data, and the compensated voltage being generated based on the predetermined unit voltage and the detected specific value.

In order to obtain the above advantage, the second display apparatus of the present invention is a display apparatus for displaying image information in accordance with display data, comprising:

a display panel having a light-emitting element and a pixel drive circuit for controlling a light-emitting status of the light-emitting element in which a plurality of display pixels are arranged, wherein:

the pixel drive circuit comprises:

a first switching element which includes a control terminal and a current path, and one end of the current path is applied with a power source voltage and the other end of the current path is connected with a connection contact point to the light-emitting element and the connection contact point is applied with a signal voltage based on the display data;

a second switching element which includes a control terminal and a current path, and one end of the current path is applied with the power source voltage and the other end of the current path is connected with the control terminal of the first switching element; and a voltage holding element connected between the control terminal of the first switching element and the connection contact point, wherein:

the power source voltage is set to any of a first voltage having a value for causing the light-emitting element to be in a no-light-emitting status and a second voltage having a value for causing the light-emitting element to be in a light-emitting status.

In order to obtain the above advantage, a drive method of the display drive apparatus of the present invention or the first drive method of a display apparatus of the present invention is a drive method of a display drive apparatus which drives a display pixel including a light-emitting element and a drive element, comprising:

a step of applying a detection voltage based on a predetermined unit voltage to the display pixel;

a step of detecting, based on a value of current flowing in a current path of the drive element, a specific value corresponding to an element characteristic of the drive element;

a step of generating a gradation voltage corresponding to a luminance gradation indicated by display data;

a step of generating a compensated voltage based on the specific value and the unit voltage; and a step of generating a compensated gradation voltage by compensating the gradation voltage based on the compensated voltage, and supplying the compensated gradation voltage to the display pixel.

In order to obtain the above advantage, the first drive method of a display apparatus of the present invention is a drive method of a display drive apparatus which drives a display pixel including a light-emitting element and a drive element, comprising:

a step of applying a detection voltage based on a predetermined unit voltage to the display pixel;

a step of detecting, based on a value of current flowing in a current path of the drive element, a specific value corresponding to an element characteristic of the drive element;

a step of generating a gradation voltage corresponding to a luminance gradation indicated by display data;

a step of generating a compensated voltage based on the specific value and the unit voltage; and a step of generating a compensated gradation voltage by compensating the gradation voltage based on the compensated voltage, and supplying the compensated gradation voltage to the display pixel.

In order to obtain the above advantage, the second drive method of a display apparatus of the present invention is a drive method of a display apparatus for displaying image information in accordance with display data, wherein:

the display apparatus has a display panel in which, in the vicinity of the respective intersection points of a plurality of selection lines and data lines arranged in a row direction and a column direction, a plurality of display pixels are arranged that include light-emitting elements and drive elements for supplying current flowing in a current path to the light-emitting elements, the method comprises:

a step of sequentially applying a selection signal to the respective plurality of selection lines to sequentially set the display pixels in the respective rows to a selected status;

a step of applying, via the respective data lines, a detection voltage based on a predetermined unit voltage to the respective display pixels in the selected rows;

a step of detecting, based on values of currents flowing in current paths of the drive elements of the respective display pixels, specific values corresponding to element characteristics of the drive elements, and a step of generating a gradation voltage corresponding to a luminance gradation indicated by display data;

a step of generating a compensated voltage based on the specific value and the unit voltage; and a step of generating a compensated gradation voltage obtained by compensating the gradation voltage based on the compensated voltage, and supplying the compensated gradation voltage via the respective data lines, to the respective display pixels in the selected rows.

BRIEF DESCRIPTION OF THE DRAWINGS

These objects and other objects and advantages of the present invention will become more apparent upon reading of the following detailed description and the accompanying drawings in which:

FIG. 8B is a characteristic diagram illustrating an operation characteristic of a drive transistor of a display pixel as well as a load characteristic of an organic EL element in a light-emitting operation;

DETAILED DESCRIPTION OF THE PREFERRED EMBODIMENTS

Figure 1:
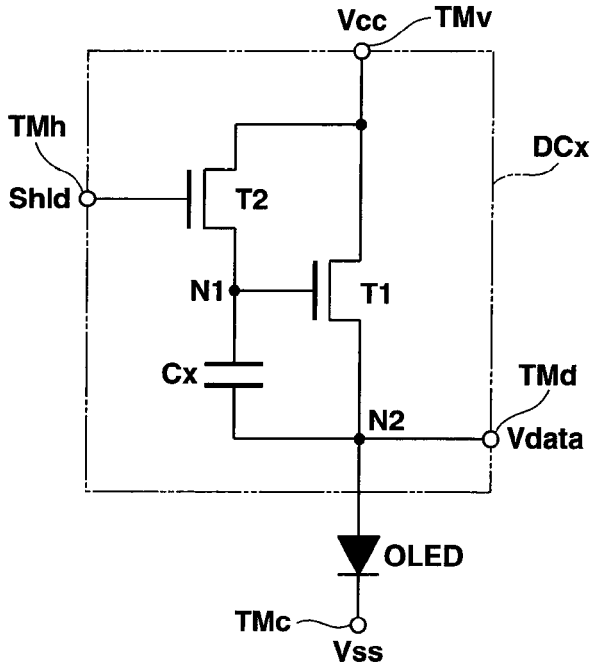
FIG. 1 is an equivalent circuit diagram illustrating the main structure of a display pixel applied to a display apparatus according to the present invention.

Hereinafter, a display drive apparatus and the drive method thereof according to the present invention as well as a display apparatus and the drive method thereof will be described based on embodiments shown in the drawings.

<Main Structure of Display Pixel>

First, the main structure and the control operation of a display pixel used in a display apparatus according to the present invention will be described with reference to the drawings.

FIG. 1 is an equivalent circuit diagram illustrating the main structure of a display pixel used in a display apparatus according to the present invention.

The following section will describe a case where an organic EL element is conveniently used as a current control-type light-emitting element provided in a display pixel.

A display pixel used in a display apparatus according to the present invention has a circuit structure as shown in FIG. 1 that comprises a pixel drive circuit DCx and an organic EL element OLED as a current control-type light-emitting element.

The pixel drive circuit DCx has, for example, a drive transistor (the first switching element) T1 in which a drain terminal and a source terminal are connected to a power source terminal TMv and a contact point N2 to which a power source voltage Vcc is applied and a gate terminal is connected to a contact point N1, respectively; a holding transistor (the second switching element) T2 in which a drain terminal and a source terminal are connected to the power source terminal TMv (a drain terminal of the drive transistor T1) and the contact point N1 and a gate terminal is connected to a control terminal TMh, respectively; and a capacitor (voltage holding element) CX connected between the gate terminal and the source terminal of the drive transistor T1 (between the contact point N1 and the contact point N2). The organic EL element OLED is structured so that an anode terminal is connected with the contact point N2 and a cathode terminal TMc is applied with a fixed voltage Vss.

In a control operation as will be described later, depending on the operation status of a display pixel (pixel drive circuit DCx), the power source terminal TMv is applied with a different power source voltage Vcc depending on the operation status, the cathode terminal TMc of the organic EL element OLED is applied with a power source voltage Vss, the control terminal TMh is applied with a holding control signal Shld, and the data terminal TMd connected to the contact point N2 is applied with a data voltage Vdata corresponding to a luminance gradation (gray scale value) of display data.

The capacitor Cx may be a parasitic capacitance formed between the gate terminal and the source terminal of the drive transistor T1 or also may be a combination of a parasitic capacitance and capacitative elements connected in parallel between the contact point N1 and the contact point N2. Although the drive transistor T1 and the holding transistor T2 are not limited to particular element structure and characteristic for example, the following section will describe a case where the drive transistor T1 and the holding transistor T2 are an n channel-type thin film transistor.

<Control Operation of Display Pixel>

Next, a control operation (drive method) of a display pixel having a display pixel as described above (pixel drive circuit DCx and organic EL element OLED) will be described.

Figure 2:
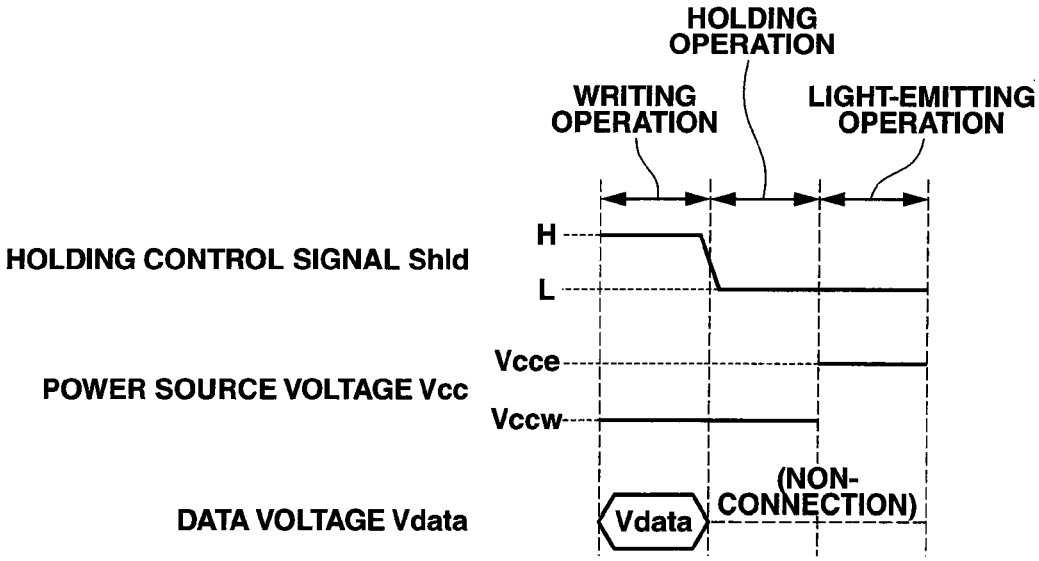
FIG. 2 is a signal waveform diagram illustrating a control operation of a display pixel used in a display apparatus according to the present invention.

FIG. 2 is a signal waveform diagram illustrating a control operation of a display pixel used in a display apparatus according to the present invention.

As shown in FIG. 2, an operation status of a display pixel (pixel drive circuit DCx) having the circuit configuration as shown in FIG. 1 can be mainly classified to a writing operation, a holding operation, and a light-emitting operation. In the writing operation, a voltage component in accordance with a luminance gradation of display data is written to the capacitor Cx. In the holding operation, the voltage component written by the writing operation is held in the capacitor Cx. In the light-emitting operation, based on the voltage component held by the holding operation, the gradation current in accordance with the luminance gradation of the display data is flowed in the organic EL element OLED so that organic EL element OLED emits light with brightness in accordance with luminance gradation of the display data. Hereinafter, the respective operation statuses will be specifically described with reference to the timing chart shown in FIG. 2.

(Writing Operation)

In a writing operation, in a light-off status in which the organic EL element OLED is prevented from emitting light, a voltage component in accordance with a luminance gradation of display data is written to the capacitor Cx.

Figure 3A:
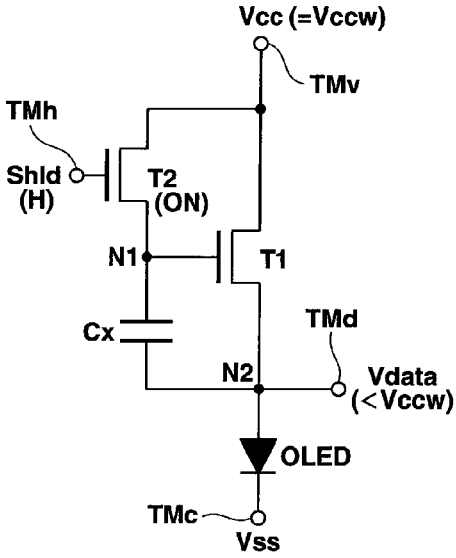
FIGS. 3A and 3B are a schematic view illustrating an operation status of a display pixel in a writing operation.
Figure 3B:
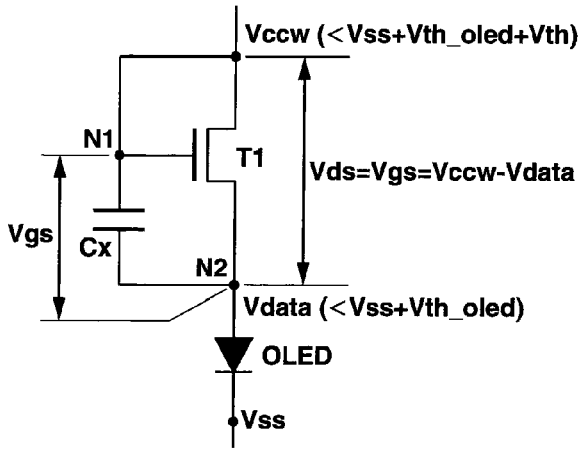

FIGS. 3A and 3B are a schematic diagram illustrating an operation status of a display pixel in the writing operation.

Figure 4A:
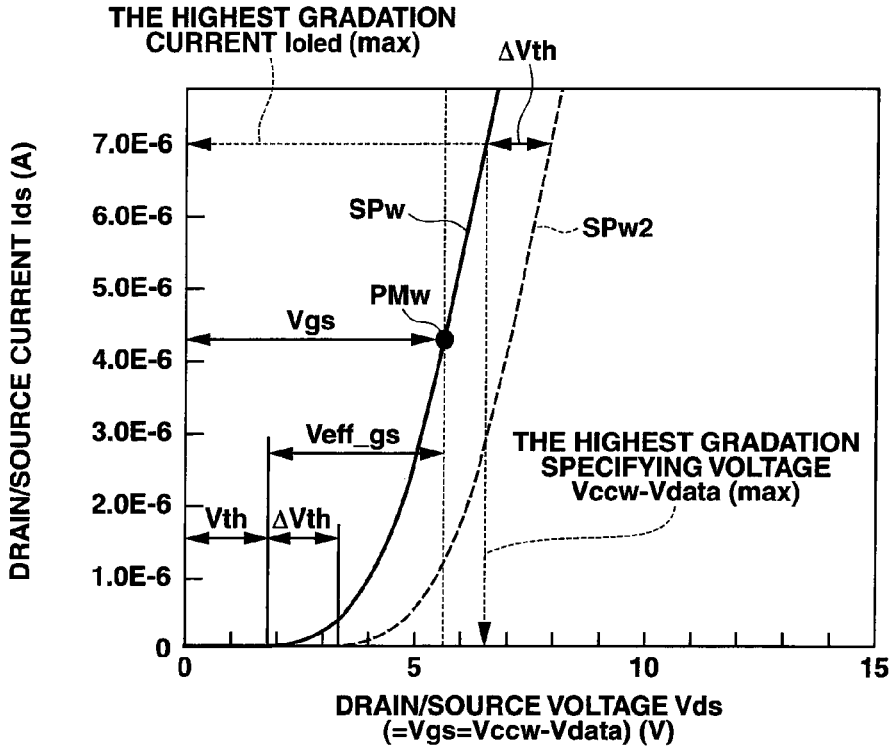
FIG. 4A illustrates operation characteristics of a drive transistor of a display pixel in the writing operation.

FIG. 4A illustrates operation characteristics of a drive transistor of a display pixel in the writing operation.

Figure 4B:
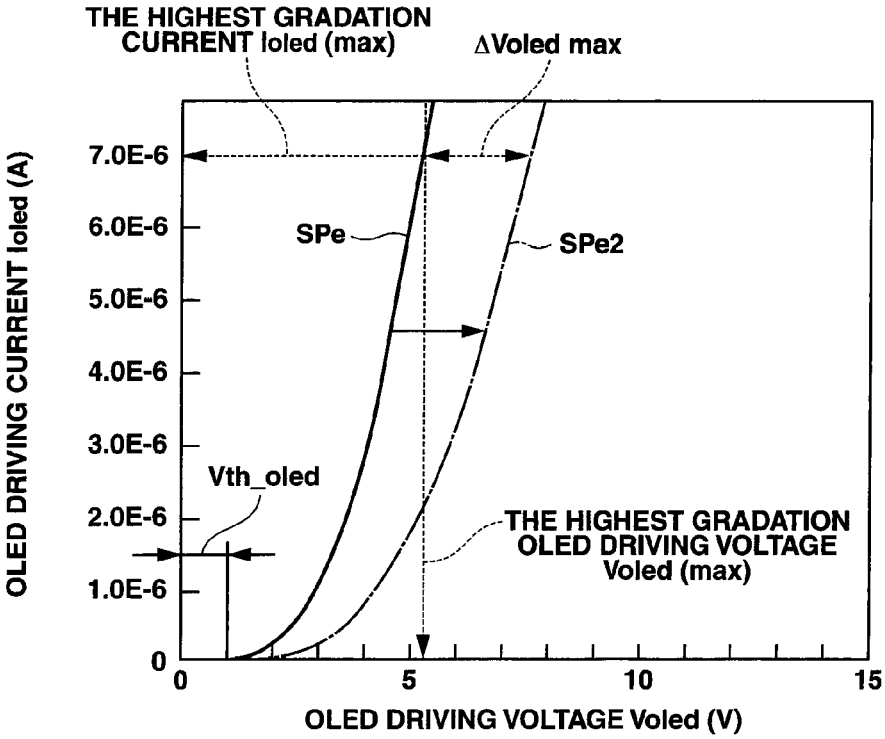
FIG. 4B is a characteristic diagram illustrating a relation between a drive current and a drive voltage of the organic EL element.

FIG. 4B is a characteristic diagram illustrating a relation between a drive current and a drive voltage of the organic EL element.

In FIG. 4A, a solid line SPw represents a characteristic line showing a relation in an initial status between a voltage Vds between a drain and a source and a current Ids between a drain and a source when a diode-connected n channel-type thin film transistor is used as the drive transistor T1. A broken line SPw2 shows an example of a characteristic line when the drive transistor T1 has a change in the characteristic due to the driving history. The details will be described later. A point PMw on the characteristic line SPw represents an operation point of the drive transistor T1.

The characteristic line SPw has a threshold voltage Vth to a drain/source current Ids. When the drain/source voltage Vds exceeds the threshold voltage Vth, the drain/source current Ids nonlinearly increases with an increase of the drain/source voltage Vds. Specifically, a value shown by Veff_gs represents a voltage component effectively constituting the drain/source current Ids. As shown in a formula (1), the drain/source voltage Vds is a sum of the threshold voltage Vth and the voltage component veff_gs.

$$Vds=Vth+veff_gs \quad (1)$$

A solid line SPe shown in FIG. 4B represents a characteristic line showing a relation in the organic EL element OLED between a drive voltage Voled and a drive current Ioled in an initial status. A dotted and dashed line SPe2 shows an example of a characteristic line when the organic EL element OLED has a change in the characteristic due to the driving history. The details will be described later. The characteristic line SPe has a threshold voltage Vth_oled to the drive voltage Voled. When the drive voltage Voled exceeds the threshold voltage Vth_oled, the drive current Ioled nonlinearly increases with an increase of the drive voltage Voled.

The writing operation is performed by, as shown in FIG. 2 and FIG. 3A, firstly applying a holding control signal Shld of an ON level (high level) to a control terminal TMh of a holding transistor T2 to cause the holding transistor T2 to start an ON operation. As a result, a gate and a drain of the drive transistor T1 are connected (or short-circuited) to set the drive transistor T1 to a diode-connected status.

Then, a terminal of a power source terminal TMv is applied with the first power source voltage Vccw for a writing operation and the data terminal TMd is applied with a data voltage Vdata corresponding to a luminance gradation of display data. Then, the drain and the source of the drive transistor T1 have therebetween the current Ids in accordance with a potential difference between the drain and the source (Vccw−Vdata). This data voltage Vdata is set to have a voltage value required for the current Ids flowing between the drain and the source to have a current value that is required for the organic EL element OLED to emit light with a brightness in accordance with the luminance gradation of the display data.

Since the drive transistor T1 is the diode-connected one, the drive transistor T1 has the drain/source voltage Vds equal to the gate/source voltage Vgs as shown in FIG. 3B, which can be represented as shown in a formula (2).

$$Vds=Vgs=Vccw-V\text{data} \quad (2)$$

Then, this gate/source voltage Vgs is written to the capacitor Cx (charging).

The following section will describe conditions required for a value of the first power source voltage Vccw. Since the drive transistor T1 is the n channel-type one, in order to flow the drain/source current Ids, the drive transistor T1 must have a positive gate potential to a source potential. The gate potential is equal to a drain potential and has the first power source voltage Vccw and a source potential has a data voltage Vdata. Thus, a relation of a formula (3) must be established.

$$V\text{data}<Vccw \quad (3)$$

The contact point N2 is connected to the data terminal TMd and to the anode terminal of the organic EL element OLED. In a writing operation, the organic EL element OLED must be in a light-off status by causing the potential Vdata of the contact point N2 to be equal to or lower than a value obtained by adding a voltage Vss of a cathode-side terminal TMc of the organic EL element OLED to a threshold voltage Vth_oled of the organic EL element OLED. Thus, the potential Vdata of the contact point N2 must satisfy a formula (4).

$$V\text{data}\leqq Vss+Vth_oled \quad (4)$$

When assuming that Vss is a ground potential OV, a formula (5) is obtained.

$$V\text{data}\leqq \text{Vth_oled} \quad (5)$$

Next, the formula (2) and the formula (5) provide a formula (6).

$$Vccw-vgs\leqq vtho_led \quad (6)$$

Based on the formula (1), Vgs=Vds=Vth+Veff_gs is established. Thus, a formula (7) is obtained.

$$Vtcw\leqq Vth_oled+vth+veff_gs \quad (7)$$

Since the formula (7) must be established even when veff_gs=0, a formula (8) is obtained when Veff_gs=0.

$$V\text{data}<Vccw\leqq Vth_oled+vth \quad (8)$$

Specifically, in a writing operation, the first power source voltage Vccw must have a value that satisfies the relation of the formula (8) in the diode-connected status. Next, the following section will describe an influence by a change in characteristics of the drive transistor T1 and the organic EL element OLED due to the driving history. It is known that the drive transistor T1 has the threshold voltage Vth that increases with the driving history.

The broken line SPw2 shown in FIG. 4A illustrates an example of a characteristic line when a change in the characteristic is caused due to a driving history. In FIG. 4A, Δth represents an amount of a change of the threshold voltage Vth. As shown, a variation in the characteristic in accordance with the driving history of the drive transistor T1 draws a line obtained by a substantial parallel displacement of the initial characteristic line. Due to this reason, a value of the data voltage Vdata required for obtaining a gradation current value (the drain/source current Ids) in accordance with a luminance gradation of the display data must be increased by a change amount ΔVth of the threshold voltage Vt.

It is also known that the organic EL element OLED has higher resistance in accordance with the driving history. The dotted and dashed line SPe2 shown in FIG. 4B shows an example of the characteristic line when a change in the characteristic is caused due to a driving history. A variation in the characteristic due to the increased resistance of the organic EL element OLED in accordance with the driving history changes, with regards to the initial characteristic line, substantially in a direction along which an increasing rate of the drive current Ioled to the drive voltage Voled declines. Specifically, in order to flow the drive current Ioled required for the organic EL element OLED to emit light with a brightness in accordance with the luminance gradation of the display data, the drive voltage Voled increases by an amount obtained by deducting the characteristic line SPe from the characteristic line SPe2. This increase is maximum, as shown by ΔVoled max in FIG. 4B, at the highest gradation at which the drive current Ioled has the maximum value Ioled (max).

(Holding Operation)

Figure 5A:
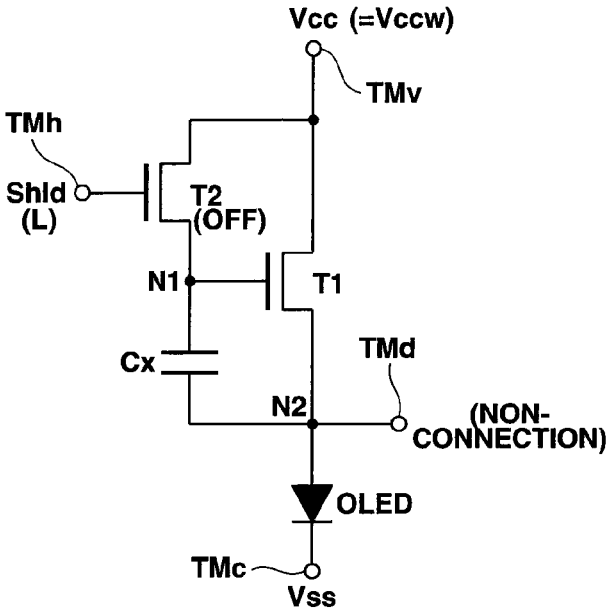
FIGS. 5A and 5B are a schematic view illustrating an operation status of a display pixel during a holding operation.
Figure 5B:
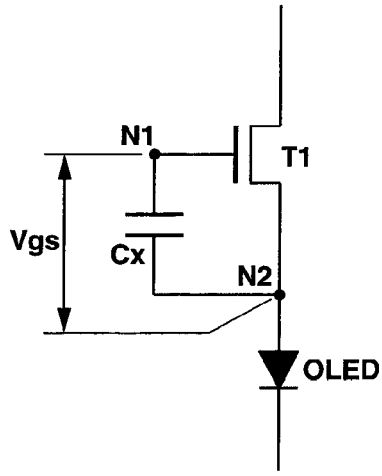

FIGS. 5A and 5B are a schematic diagram illustrating an operation status in a holding operation of a display pixel.

Figure 6:
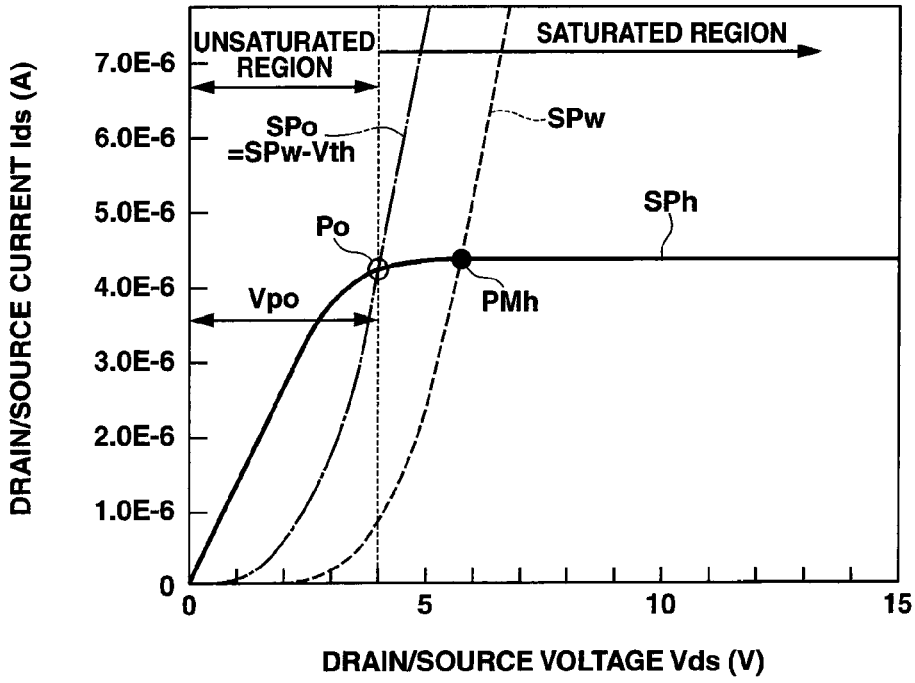
FIG. 6 is a characteristic diagram illustrating an operation characteristic of a drive transistor in a holding operation of a display pixel.

FIG. 6 is a characteristic diagram illustrating an operation characteristic of a drive transistor in a holding operation of a display pixel.

In the holding operation, as shown in FIG. 2 and FIG. 5A, the control terminal TMh is applied with a holding control signal Shld of an OFF level (low level) to cause the holding transistor T2 to be in an OFF operation to block the gate and the drain of the drive transistor T1 (or to cause the gate and the drain of the drive transistor T1 to be in a non-connection status) to cancel the diode connection. As a result, as shown in FIG. 5B, the voltage Vds between the drain and the source of the drive transistor T1 (=gate/source voltage Vgs) charged in the capacitor Cx is held in the above writing operation.

The solid line SPh shown in FIG. 6 represents a characteristic line when the diode connection of the drive transistor T1 is cancelled and the gate/source voltage Vgs has a fixed voltage.

The broken line SPw shown in FIG. 6 represents a characteristic line when the drive transistor T1 is the diode-connected one. The operation point PMh during the holding is an intersection point of the characteristic line SPh when the diode connection is provided and the characteristic line SPh when the diode connection is cancelled.

The alternate long and short dash line SPo shown in FIG. 6 is introduced as a characteristic line SPw-Vth. An intersection point Po of the alternate long and short dash line SPo and the characteristic line SPh represents a pinch-off voltage Vpo. As shown in FIG. 6, a region in the characteristic line SPh within which the drain/source voltage Vds is from 0V to the pinch-off voltage Vpo is an unsaturated region. A region in the characteristic line SPh within which the drain/source voltage Vds is equal to or higher than the pinch-off voltage Vpo is a saturated region.

(Light-Emitting Operation)

Figure 7A:
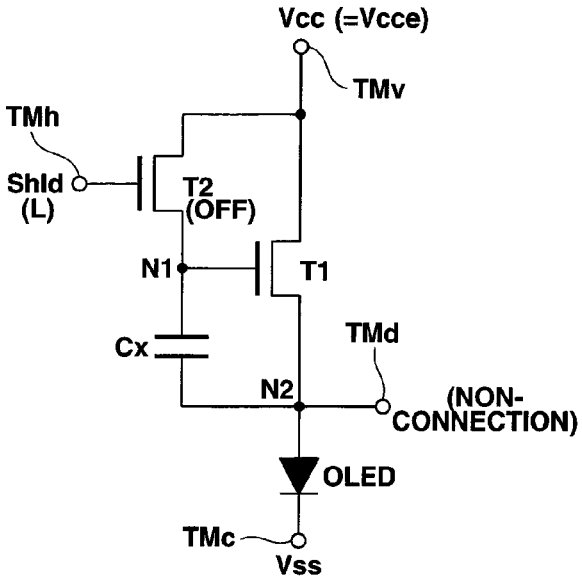
FIGS. 7A and 7B are a schematic diagram illustrating an operation status of a display pixel in a light-emitting operation.
Figure 7B:
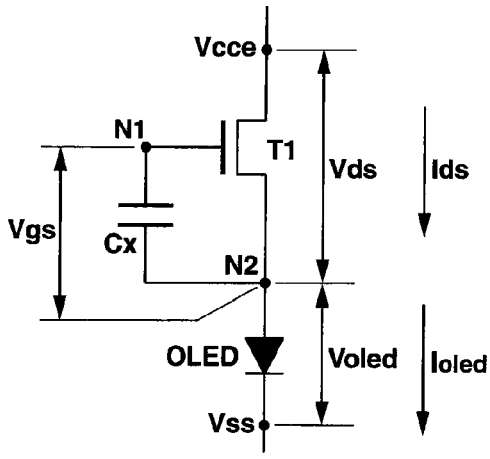

FIGS. 7A and 7B are a schematic diagram illustrating an operation status of a display pixel in a light-emitting operation.

Figure 8A:
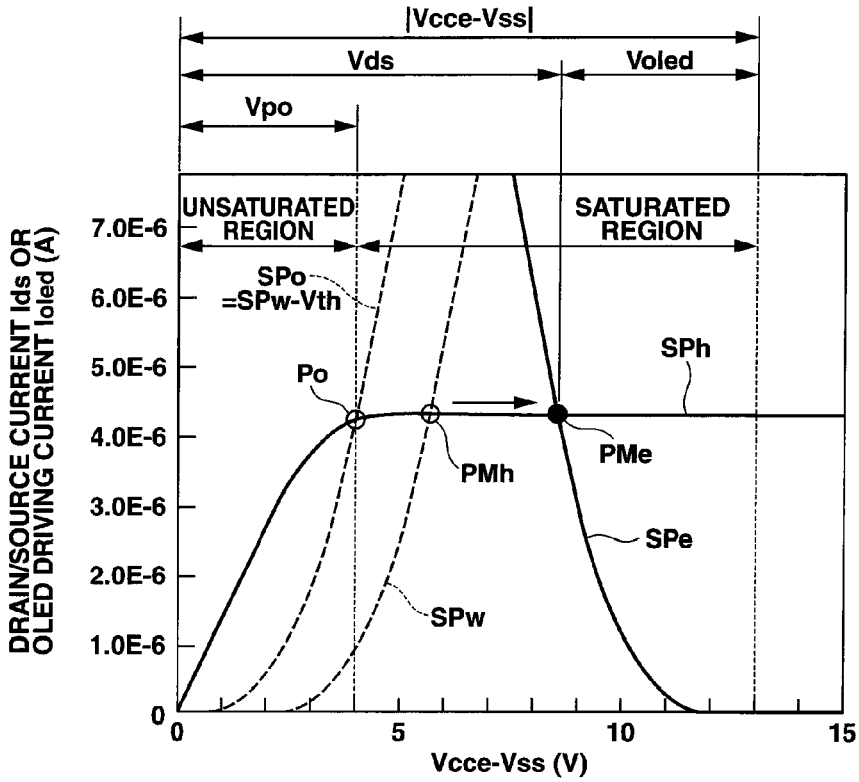
FIGS. 8A and 8B are a characteristic diagram illustrating an operation characteristic of a drive transistor of a display pixel as well as a load characteristic of an organic EL element in a light-emitting operation.
Figure 8B:
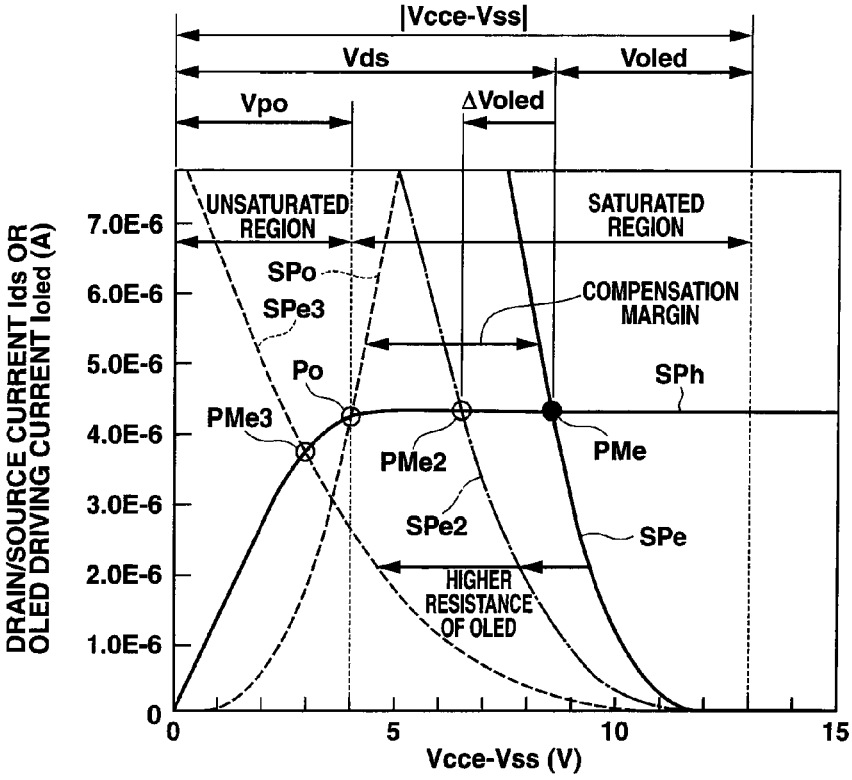

FIGS. 8A and 8B are a characteristic diagram illustrating an operation characteristic of a drive transistor of a display pixel as well as a load characteristic of an organic EL element in a light-emitting operation.

As shown in FIG. 2 and FIG. 7A, a status is maintained in which the control terminal TMh is applied with the holding control signal Shld of an OFF level (low level) (status in which the diode-connected status is cancelled). In this status, the terminal voltage Vcc of the power source terminal TMv is switched from the first power source voltage Vccw for a writing operation to the second power source voltage Vcce for a light-emitting operation. As a result, the drain and the source of the drive transistor T1 have therebetween the current Ids in accordance with the voltage component Vgs held by the capacitor Cx. This current is supplied to the organic EL element OLED. Then, the organic EL element OLED emits light with a brightness in accordance with the value of the supplied current.

The solid line SPh shown in FIG. 8A represents a characteristic line of the drive transistor T1 when the gate/source voltage Vgs is a fixed voltage. The solid line SPe represents a load line of the organic EL element OLED that is obtained by inversely plotting, based on a potential difference between the power source terminal TMv and the cathode terminal TMc of the organic EL element OLED (i.e., a value of Vcce−Vss), the drive voltage Voled—the drive current Ioled of the organic EL element OLED.

The operation point of the drive transistor T1 during the light-emitting operation moves from PMh during the holding operation to PMe that is an intersection point of the characteristic line SPh of the drive transistor T1 and the load line SPe of the organic EL element OLED. The operation point PMe represents, as shown in FIG. 8A, a point at which, when a Vcce−Vss voltage is applied between the power source terminal TMv and the cathode terminal TMc of the organic EL element OLED, this voltage is distributed between the source and the drain of the drive transistor T1 and between the anode and the cathode of the organic EL element OLED. Specifically, at the operation point PMe, the voltage Vds is applied between the source and the drain of the drive transistor T1 and the drive voltage Voled is applied between the anode and the cathode of the organic EL element OLED.

In order to allow the current Ids (expected value current) flowed between the drain and the source of the drive transistor T1 during a writing operation to be equal to the drive current Ioled supplied to the organic EL element OLED during a light-emitting operation, the operation point PMe must be maintained in the saturated region on the characteristic line. The drive voltage Voled is the maximum Voled (max) at the highest gradation. Thus, in order to maintain the above-described PMe in a saturated region, the second power source voltage Vcce must have a value satisfying the conditions of a formula (9).

$$Vcce-Vss \geqq Vpo+Voled(\max) \tag{9}$$

When assuming that Vss is a ground potential of 0V, a formula (10) is established.

$$Vcce \geqq Vpo+Voled(\max) \tag{10}$$

<Relation Between a Variation of an Organic Element Characteristic and a Voltage-Current Characteristic>

As shown in FIG. 4B, the organic EL element OLED has higher resistance in accordance with the driving history and changes in a direction along which the increasing rate of the drive current Ioled to the drive voltage Voled declines. Specifically, the organic EL element OLED changes in a direction along which a slope of the load line SPe of the organic EL element OLED shown in FIG. 8A declines. FIG. 8B illustrates the change of the organic EL element OLED in accordance with the driving history of the load line SPe in which the load line changes in an order of SPe, SPe2, and SPe3. Consequently, the operation point of the drive transistor T1 moves, in accordance with the driving history, on the characteristic line SPh of the drive transistor T1 in an order of PMe, PMe2, and PMe3.

During a period in which the operation point is within the saturated region (PMe to PMe2) on the characteristic line, the drive current Ioled maintains the value of the expected value current during the writing operation. However, when the operation point is in the unsaturated region (PMe3), the drive current Toled is smaller than the expected value current during the writing operation, causing a defective display. In FIG. 8B, a pinch-off point Po is at a boundary between the unsaturated region and the saturated region. Specifically, a potential difference between the operation points PMe and Po during a light-emitting operation functions as a compensation margin for maintaining an OLED drive current against higher resistance of the organic EL during a light-emitting operation. In other words, a potential difference of a drive transistor on the characteristic line SPh sandwiched by a pinch-off point trajectory SPo and the load line SPe of the organic EL element at the respective Ioled levels functions as a compensation margin. As shown in FIG. 8B, this compensation margin decreases with an increase of a value of the drive current Ioled and increases with an increase of the voltage Vcce−Vss applied between the power source terminal TMv and the cathode terminal TMc of the organic EL element OLED.

<Relation Between a Variation of a TFT Element Characteristic and a Voltage-Current Characteristic>

By the way, in the above-described voltage gradation control using a transistor applied to a display pixel (pixel drive circuit), the data voltage Vdata is set based on a drain/source voltage Vds-drain/source current Ids characteristic of a transistor that is previously set at an initial stage. However, the threshold voltage Vth increases, as shown in FIG. 4A, in accordance with the driving history and the current value of the drive current supplied to the light-emitting element (organic EL element OLED) does not correspond to the display data (data voltage), thus failing to provide a light-emitting operation with appropriate brightness and gradation. It is known that, when an amorphous silicon transistor is used as a transistor in particular, a significant variation in the element characteristic is caused.

Here, an example of initial characteristics (voltage-current characteristic) of the drain/source voltage Vds and the drain/source current Ids will be shown in a case in which an amorphous silicon transistor having design values as shown in Table 1 is used for a display operation with 256 gradations.

TABLE 1

| <Design values of the transistor> | |
|---|---|
| Thickness of gate insulating film | 300 nm (3000 Å) |
| Channel width W | 500 μm |
| Channel length L | 6.28 μm |
| Threshold value voltage Vth | 2.4 V |

In the voltage-current characteristic in an n channel-type amorphous silicon transistor (i.e., a relation shown in FIG. 4A between the drain/source voltage Vds and the drain/source current Ids), carrier trap to a gate insulating film due to the driving history or a temporal change causes the cancellation of a gate electric field to cause an increase of Vth (shift from SPw in the initial status to SPw2 at a high voltage side). Thus, when the drain-source voltage Vds applied to the amorphous silicon transistor is fixed, the drain/source current Ids decreases and the brightness and the gradation of the light-emitting element decrease.

When this variation in the element characteristic is caused, the threshold voltage Vth mainly increases and the voltage-current characteristic line (V-I characteristic line) of the amorphous silicon transistor is a substantial parallel displacement of the characteristic line in the initial status. Thus, the V-I characteristic line SPw2 after the shift can be substantially equal to a voltage-current characteristic when the drain/source voltage Vds of the V-I characteristic line SPw in the initial status is uniquely added with a fixed voltage (which corresponds to an offset voltage Vofst (which will be described later)) corresponding to the change amount Δvth (about V in the drawing) of the threshold voltage Vth (i.e., when the V-I characteristic line SPw is parallelly displaced by ΔVth).

In other words, when display data is written to the display pixel (pixel drive circuit DCx), a compensated data voltage (which corresponds to a compensated gradation voltage Vpix (which will be described later)) obtained by adding a corresponding fixed voltage (offset voltage Vofst) to the change amount ΔV of the element characteristic (threshold voltage) of the drive transistor T1 provided in the display pixel is applied to the source terminal (contact point N2) of the drive transistor T1 to compensate the shift of the voltage-current characteristic due to the variation of the threshold voltage Vth of the drive transistor T1. Thus, a drive current Iem having a current value in accordance with the display data can be flowed in the organic EL element OLED to allow the organic EL element OLED to emit light with desired brightness and gradation.

It is noted that a holding operation for switching the holding control signal Shld from the ON level to the OFF level also may be synchronously performed with a light-emitting operation for switching the power source voltage Vcc from the voltage Vccw to the voltage Vcce.

The following section will specifically describe the entire structure of a display apparatus including a display panel in which a plurality of display pixels having the main structure of the pixel drive circuit as described above are arranged in a two-dimensional manner.

<Display Apparatus>

Figure 9:
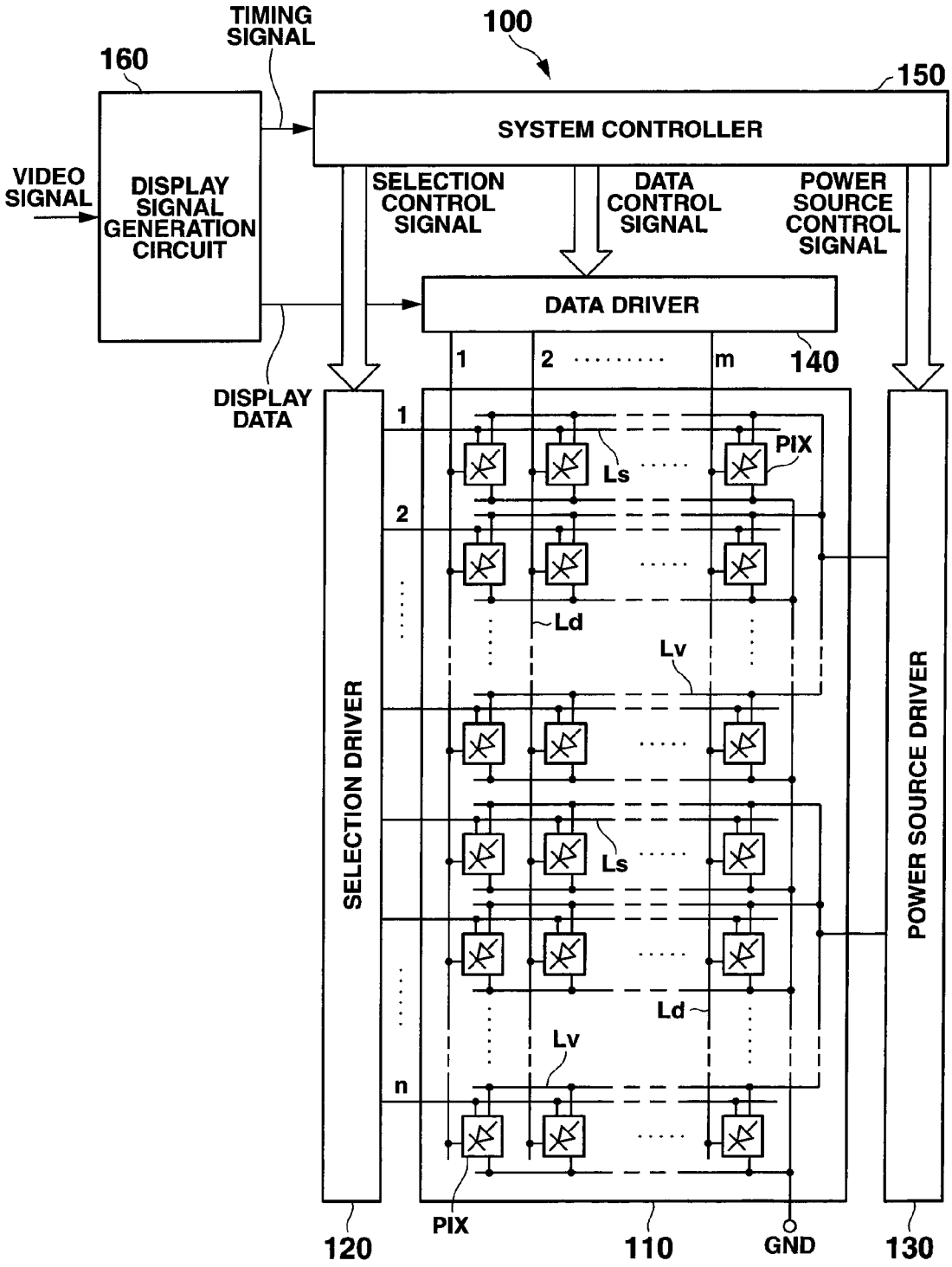
FIG. 9 is a schematic view illustrating the structure of one embodiment of a display apparatus according to the present invention.

FIG. 9 is a schematic diagram illustrating the structure of one embodiment of a display apparatus according to the present invention.

Figure 10:
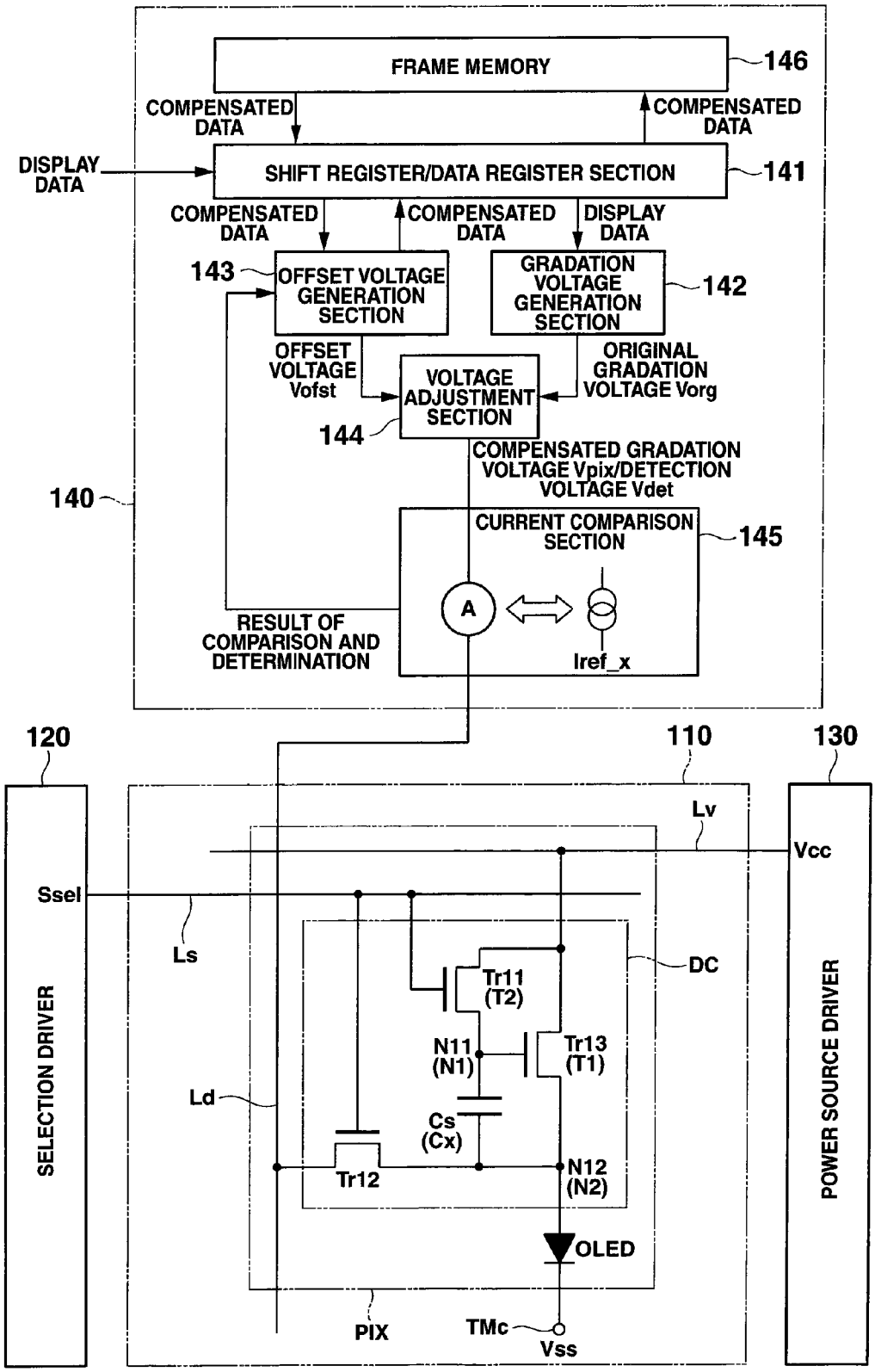
FIG. 10 illustrates the main structure of a data driver and a display pixel that can be applied to a display apparatus according to this embodiment.

FIG. 10 illustrates the main structure of a data driver and a display pixel that can be applied to a display apparatus according to this embodiment.

FIG. 10 also shows reference numerals of a circuit components corresponding to the above-described pixel drive circuit DCx (see FIG. 1). Although FIG. 10 conveniently shows various signals and data exchanged among the respective parts of the data driver as well as all of applied currents and voltages by arrows, these signals, data, currents, and voltages are not always simultaneously sent or applied as described later.

As shown in FIG. 9 and FIG. 10, a display apparatus 100 according to this embodiment is structured to include, for example, a display panel 110 in which a plurality of display pixels PIX having the main structure (see FIG. 1) of the pixel drive circuit DCx are arranged in a matrix of n rows×m columns (n and m are an arbitrary positive integer) in the vicinity of the respective intersection points of a plurality of selection lines Ls arranged in a row direction (the left and right direction in the drawings) and a plurality of data lines Ld arranged in a column direction (the up and down direction in the drawings); a selection driver (selection driving section) 120 for applying a selection signal Ssel to the respective selection lines Ls with a predetermined timing; a power source driver (power source driving section) 130 for applying, with a predetermined timing, the power source voltage Vcc having a predetermined voltage level to a plurality of power source voltage lines LV arranged in a row direction in parallel with the selection lines Ls; a data driver (display drive apparatus, data driving section) 140 for supplying, with a predetermined timing, a gradation signal (compensated gradation voltage Vpix) to the respective data lines Ld; a system controller 150 for generating, based on a timing signal supplied from a display signal generation circuit 160 (which will be described later), a selection control signal and a power source control signal and a data control signal for controlling at least the operation statuses of the selection driver 120, the power source driver 130, and the data driver 140 to output the signals; and a display signal generation circuit 160 for generating, based on a video signal supplied from the outside of the display apparatus 100 for example, display data (data for brightness and gradation) comprising a digital signal to supply the data to the data driver 140 to extract or generate, based on the display data, a timing signal (e.g., system clock) for displaying predetermined image information on the display panel 110 to supply the timing signal to the above system controller 150.

The following section will describe the respective components as described above.

(Display Panel)

In the display apparatus 100 according to this embodiment, a plurality of display pixels PIX arranged on a substrate of a display panel 110 in a matrix-like manner are divided, for example, to a group in an upper region and a group in a lower region of the display panel 110 as shown in FIG. 9. Display pixels PIX included in each group are connected to the individual branched power source voltage lines Lv. Specifically, the power source voltages Vcc commonly applied to the first to n/2th display pixels PIX in the upper region of the display panel 110 and the power source voltages Vcc commonly applied to 1+n/2th to the nth display pixels PIX in the lower region are independently outputted by the power source driver 130 with different timings and via different power source voltage lines Lv. It is noted that the selection driver 120 and the data driver 140 also may be provided in the display panel 110 or the selection driver 120, the power source driver 130, and the data driver 140 also may be provided in the display panel 110.

(Display Pixel)

The display pixel PIX applied to this embodiment is provided in the vicinity of an intersection point of the selection line Ls connected to the selection driver 120 and the data line Ld connected to the data driver 140 and comprises, as shown in FIG. 10, the organic EL element OLED as a current control type light-emitting element and the pixel drive circuit DC that comprises the main structure of the above-described pixel drive circuit DCx (see FIG. 1) and that generates a drive current for driving the organic EL element OLED for light emission for example.

The pixel drive circuit DC comprises, for example, a transistor Tr11 (diode connection transistor; the second switch circuit) in which a gate terminal is connected to the selection line Ls, a drain terminal is connected to the power source voltage line Lv, and a source terminal is connected to the contact point N11, respectively; a transistor Tr12 (selection transistor) in which a gate terminal is connected to the selection line Ls, a source terminal is connected to the data line Ld, and a drain terminal is connected to the contact point N12, respectively; a transistor Tr13 (drive transistor; drive element, the first switch circuit) in which a gate terminal is connected to the contact point N11, a drain terminal is connected to the power source voltage line Lv, and a source terminal is connected to the contact point N12, respectively; and a capacitor (voltage holding element) Cs connected between the contact point N11 and the contact point N12 (between a gate terminal and a source terminal of the transistor Tr13).

The transistor Tr13 corresponds to the drive transistor T1 shown in the above-described main structure of the pixel drive circuit DCx (FIG. 1). The transistor Tr11 corresponds to the holding transistor T2. The capacitor Cs corresponds to the capacitor Cx. The contact points N11 and N12 correspond to the contact point N1 and the contact point N2, respectively. The selection signal Ssel applied from the selection driver 120 to the selection line Ls corresponds to the above-described holding control signal Shld. The gradation signal applied from the data driver 140 to the data line Ld (compensated gradation voltage Vpix or detection voltage Vdet) corresponds to the above-described data voltage Vdata.

The organic EL element OLED is structured so that an anode terminal is connected to the contact point N13 of the pixel drive circuit DC and a cathode terminal TMc is applied with the reference voltage Vss as a fixed low voltage.

In a driving control operation of a display apparatus (which will be described later), in a writing operation period during which a gradation signal in accordance with display data (compensated gradation voltage Vpix) is supplied to the pixel drive circuit DC, the compensated gradation voltage Vpix applied from the data driver 140, the reference voltage Vss, as well as the power source voltage Vce (=Vcce) having a high potential applied to the power source voltage line Lv during the light-emitting operation period satisfy the above-described relations (3) to (10). Thus, the organic EL element OLED is prevented from being lighting.

The capacitor Cs may be a parasitic capacitance formed between the gate and the source of the transistor Tr13 or also may be a combination of a parasitic capacitance and a capacitative element other than the transistor Tr13 connected between the contact point N11 and the contact point N12 or also may be both of the former and the latter.

Although the transistors Tr11 to Tr13 are not particularly limited, the transistors Tr11 to Tr13 can be n channel-type field-effect transistors for example to use an n channel-type amorphous silicon thin film transistor. In this case, an already-established technique for manufacturing amorphous silicon can be used to manufacture a pixel drive circuit DC comprising an amorphous silicon thin film transistor having stable operation characteristics (e.g., electronic mobility) with a relatively simple manufacture process. The following section will describe a case where the transistors Tr11 to Tr13 are all made by an n channel-type thin film transistor.

The display pixel PIX (pixel drive circuit DC) is not limited to the circuit configuration shown in FIG. 10. The display pixel PIX also may have another circuit configuration so long as the circuit configuration comprises at least elements corresponding to the drive transistor T1, the holding transistor T2, and the capacitor Cx as shown in FIG. 1 and comprises a current path of the drive transistor T1 serially connected to a current control type light-emitting element (organic EL element OLED). Furthermore, a light-emitting element driven by the pixel drive circuit DC for light emission is also not limited to the organic EL element OLED. Thus, another current control type light-emitting element such as a light-emitting diode also can be used.

(Selection Driver)

The selection driver 120 applies, based on a selection control signal supplied from the system controller 150, the selection signals Ssel of a selected level (high level in the display pixel PIX shown in FIG. 10) to the respective selection lines Ls to set the display pixels PIX in the respective rows to a selected status. Specifically, with regards to the display pixels PIX in the respective rows, during a compensated data acquisition operation period and a writing operation period (which will be described later), an operation for applying the selection signal Ssel of a high level to the selection line Ls of the row is sequentially performed for the respective rows with a predetermined timing to sequentially set the display pixels PIX in the respective rows to a selected status.

The selection driver 120 may be, for example, the one that comprises a shift register for sequentially outputting, based on a selection control signal (which will be described late) supplied from the system controller 150, shift signals corresponding to the selection lines Ls in the respective rows and an output circuit section (output buffer) for converting the shift signals to have a predetermined signal level (selected level) to output the converted signals as selection signals Ssel to the selection lines Ls in the respective rows. So long as the selection driver 120 has a driving frequency in a range within which an amorphous silicon transistor can operate, transistors included in the selection driver 120 may be partially or entirely manufactured together with a part or the entirety of the transistors Tr11 to Tr13 in the pixel drive circuit DC.

(Power Source Driver)

During a compensated data acquisition operation period and a writing operation period (which will be described later), the power source driver 130 applies, based on the power source control signal supplied from the system controller 150, at least the power source voltage Vcc having a low potential (=Vccw: the first voltage) to the respective power source voltage lines Lv. During the light-emitting operation period, the power source driver 130 applies the power source voltage Vcc having a higher potential (=Vcce: the second voltage) than the power source voltage Vccw having a low potential to the respective power source voltage lines Lv.

In this embodiment, the display pixels Prx are divided to a group in an upper region and a group in a lower region of the display panel 110 for example as shown in FIG. 9 so that each group comprises individual branched power source voltage lines Lv. Thus, during the respective operation periods, the display pixels PIX arranged within a single region (i.e., the display pixels PIX included in a single group) are applied with the power source voltage Vcc having a single voltage level via the branched power source voltage lines Lv arranged within the region.

The power source driver 130 may be, for example, the one that comprises a timing generator for generating, based on a power source control signal supplied from the system controller 150, timing signals corresponding to the power source voltage lines LV in the respective regions (groups) (e.g., a shift register for sequentially outputting a shift signal) and an output circuit section for converting a timing signal to have a predetermined voltage level (voltage value Vccw, Vcce) to output the converted signal as the power source voltage Vcc to the power source voltage lines Lv in each region.

(Data Driver)

The data driver 140 detects a specific value (offset setting value Vofst) corresponding to an amount of a variation of an element characteristic (threshold voltage) of the transistor Tr13 for driving for light emission (which corresponds to the drive transistor T1) provided in each display pixel PIX arranged in the display panel 110 (pixel drive circuit DC) to memorize the value as compensated data for each display pixel PIX. The data driver 140 also compensates, based on the above compensated data, a signal voltage (original gradation voltage Vorg) in accordance with display data (data for brightness and a gradation) for each display pixel PIX supplied from the display signal generation circuit 160 (which will be described later) to generate compensated gradation voltage Vpix to supply the compensated gradation voltage Vpix to each display pixel PIX via the data line Ld.

The data driver 140 comprises, as shown in FIG. 10 for example, a shift register/data register section (gradation data transfer circuit, specific value transfer circuit, compensated data transfer circuit) 141; a gradation voltage generation section (gradation voltage generation circuit) 142; an offset voltage generation section (specific value detection circuit, detection voltage setting circuit, specific value extraction circuit, compensated voltage generation circuit) 143; a voltage adjustment section (gradation voltage compensation circuit) 144; a current comparison section (specific value detection circuit, current comparison circuit) 145; and a frame memory (memory circuit) 146. The gradation voltage generation section 142, the offset voltage generation section 143, the voltage adjustment section 144, and the current comparison section 145 are provided for every data line Ld of each row. In the display apparatus 100 according to this embodiment, "m" combinations of the gradation voltage generation section 142, the offset voltage generation section 143, the voltage adjustment section 144, and the current comparison section 145 are provided. Although this embodiment will describe a case as shown in FIG. 10 in which the frame memory 146 is included in the data driver 140, the invention is not limited to this. The frame memory 146 also may be independently provided outside of the data driver 140.

The shift register/data register section 141 comprises, for example, a shift register for sequentially outputting a shift signal based on a data control signal supplied from the system controller 150 and a data register for transferring, based on the shift signal, display data supplied from the display signal generation circuit 160 to the gradation voltage generation section 142 provided for every column to acquire, when a compensated data acquisition operation is performed, compensated data outputted from the offset voltage generation section 143 provided for every column to output the data to the frame memory 146 and for acquiring, when a writing operation and a compensated data acquisition operation are performed, compensated data outputted from the frame memory 146 to transfer the data to the offset voltage generation section 143.

The shift register/data register section 141 selectively performs at least any of: an operation for sequentially acquiring display data (data for brightness and gradation) corresponding to the display pixels PIX of one row of the display panel 110 that is sequentially supplied as serial data from a display signal generation circuit 160 (which will be described later) to transfer the data to the gradation voltage generation section 14 provided in every column; an operation for acquiring, based on the result of comparison and determination by the current comparison section 145, compensated data corresponding to a variation amount of the element characteristic (threshold voltage) of the transistor Tr13 and the transistor Tr12 of each display pixel PIX (pixel drive circuit DC) that is outputted from the offset voltage generation section 143 provided in every column to sequentially transfer the data to frame memory 146; and an operation for sequentially acquiring the above compensated data of the display pixel PIX for one specific row from the frame memory 146 to transfer the data to the offset voltage generation section 143 provided in every column. The respective operations will be described later in detail.

The gradation voltage generation section 142 generates, based on the above the display data of each display pixel PIX acquired via the shift register/data register section 141, an original gradation voltage Vorg having a voltage value for causing the organic EL element OLED to perform a light-emitting operation or a nonluminescence operation (black display operation) with predetermined brightness and gradation to output the original gradation voltage Vorg.

A structure for generating the original gradation voltage Vorg having a voltage value in accordance with display data may be provided, for example, to include a digital-analog converter (D/A converter) for converting, based on a gradation reference voltage (a reference voltage in accordance with a gradation number included in display data) supplied from a power source supply section (not shown), a digital signal voltage of the above display data to an analog signal voltage; and an output circuit for outputting, with a predetermined timing, the analog signal voltage as the original gradation voltage Vorg.

The offset voltage generation section 143 generates, based on the compensated data acquired from the frame memory 146, an offset voltage (compensated voltage) Vofst in accordance with a change amount of a threshold voltage of the transistor Tr13 of each display pixel PIX (pixel drive circuit DC) (which corresponds to ΔVth shown in FIG. 4A) to output the voltage. When the pixel drive circuit DC has the circuit configuration shown in FIG. 10, current flowing in the data line Ld during a writing operation is set so that current is drawn from the data line Ld to the data driver 140. Thus, the resultant generated offset voltage (compensated voltage) Vofst is also set so that current flows from the power source voltage line Lv via between the drain and the source of the transistor Tr13 and between the drain and the source of the transistor Tr12, and the data line Ld.

Specifically, the offset voltage (compensated voltage) Vofst in a writing operation has a value satisfying the following formula (11).

$$Vofst = Vunit \times Minc \quad (11)$$

In this formula, Vunit represents a unit voltage that is a previously set minimum voltage unit and that is a negative potential. In this formula, "Mine" represents an offset setting value for compensated digital data read from the frame memory 146. The details will be described later.

In this manner, the offset voltage Vofst is a voltage obtained by compensating a change amount of a threshold voltage of the transistor Tr12 and a change amount of a threshold voltage of the transistor Tr13 of each display pixel PIX (pixel drive circuit DC) so that a compensated gradation current approximated to have a current value of a normal gradation by the compensated gradation voltage Vpix flows between the drain and the source of the transistor Tr13.

On the other hand, in a compensated data acquisition operation performed prior to the above writing operation, a value of the offset setting value (variable) Mine that is multiplied with the above unit voltage Vunit is appropriately changed until the offset setting value (variable) Mine is optimal. Specifically, the offset voltage Vofst in accordance with the value of the initial offset setting value Mine is generated to output, based on the result of comparison and determination results outputted from the current comparison section 145, the offset setting value Mine as the above compensated data to the shift register/data register section 141.

The offset setting value Mine as described above may be set by, for example, such a counter that is provided in the offset voltage generation section 143 and that operates with a predetermined clock frequency to function, when receiving a signal having a predetermined voltage value acquired at a timing of the clock frequency CK, to increase the counter value by one. Based on the result of comparison and determination, the count value of the counter may be sequentially modulated (or increased for example). Alternatively, based on the result of comparison and determination, an appropriately modified set value also may be supplied from the system controller 150 for example.

Although the unit voltage Vunit can be set to an arbitrary fixed voltage, the smaller absolute value the unit voltage Vunit has, the smaller voltage difference is caused between the offset voltages Vofst. Thus, the offset voltage Vofst closer to a change amount of a threshold voltage of the transistor Tr13 of each display pixel PIX (pixel drive circuit DC) can be generated in a writing operation, thus compensating a gradation signal in a finer and more appropriate manner.

This unit voltage Vunit may be, for example, a voltage difference between the drain/source voltages Vds of neighboring gradations in a voltage-current characteristic of a transistor (e.g., the operation characteristic diagram shown in FIG. 4A). The unit voltage Vunit as described above may be, for example, stored in a memory provided in the offset voltage generation section 143 or the data driver 140 or also may be supplied from the system controller 150 for example and may be temporarily stored in a register provided in the data driver 140.

In this case, the unit voltage Vunit is preferably the smallest potential difference among potential differences obtained by deducting, from the drain/source voltage Vds_k (positive voltage value) for the kth gradation (The reference mark "k" is an integer. The higher k is, it represents higher brightness and gradation) of the transistor Tr13, the drain/source voltage Vds_k+1 (>vds_k) for the (k+1) th gradation. When a thin film transistor such as the transistor Tr13 (amorphous silicon TFT in particular) is combined with the organic EL element OLED for which the brightness of emitted light substantially linearly increases with regards to the current density of current flowing therethrough, a tendency is generally found in which, the higher the gradation is (i.e., the higher the drain/source voltage Vds is or the higher the drain/source current Ids is), neighboring gradations have therebetween a smaller potential difference. Specifically, when a voltage gradation control for 256 gradations is performed (based on the assumption that the $0^{th}$ gradation is associated with nonluminescence), the voltage Vds at the highest brightness and gradation (e.g., $255^{th}$ gradation) and the voltage Vds at the $254^{th}$ gradation have therebetween the smallest potential difference among those among neighboring gradations. Due to this reason, the unit voltage Vunit is preferably a value obtained by deducting, from the drain/source voltage Vds having a brightness and a gradation lower by one unit than the highest brightness and gradation (or a gradation close to the highest brightness and gradation), the drain/source voltage Vds of the highest brightness and gradation (or a gradation close to the highest brightness and gradation).

The voltage adjustment section 144 adds the original gradation voltage Vorg outputted from the gradation voltage generation section 142 to the offset voltage Vofst outputted from the offset voltage generation section 143 to output the resultant value to the data line Ld arranged in the column direction in the display panel 110 via the current comparison section 145. Specifically, in the compensated data acquisition operation, the original gradation voltage Vorg_x corresponding to the predetermined gradation (gradation x) outputted from the gradation voltage generation section 142 is added, in an analog manner, with the offset voltage Vofst generated based on an offset setting value optimized by the appropriate modification to output a voltage component of the total sum as the detection voltage Vdet to the data line Ld.

In the writing operation, the compensated gradation voltage Vpix is a value satisfying the following (12).

$$Vpix=Vorg+Vofst \quad (12)$$

Specifically, the original gradation voltage Vorg in accordance with display data outputted from the gradation voltage generation section 142 is added with the offset voltage Vofst generated by the offset voltage generation section 143 based on the compensated data acquired from the frame memory 146 in an analog manner (when the gradation voltage generation section 142 comprises a D/A converter) or a in a digital manner. Then, a voltage component as the total sum is outputted as the compensated gradation voltage Vpix to the data line Ld in a writing operation.

The current comparison section 145 comprises therein an ammeter (current measurement circuit). Thus, the current comparison section 145 in the compensated data acquisition operation applies the detection voltage Vdet generated by the voltage adjustment section 144 to the data line Ld to measure, based on a potential difference between the data line Ld and the power source voltage Vcc (=Vccw) applied to the power source voltage line Lv, a current value of the detected current Idet flowing in the data line Ld. Then, the current comparison section 145 compares the current value with an expected current Iref_X (e.g., a current value required for the organic EL element OLED to emit light with the highest brightness and gradation) as a predetermined current value at a previously-set predetermined gradation x (e.g., the highest brightness and gradation) to output the magnitude relation (the result of comparison and determination) to the offset voltage generation section 143.

This expected current value Iref_X corresponds to the current value of the current Ids flowing between the drain and the source of the drive transistor Tr13 of the pixel drive circuit DC when the drive transistor (drive element, the first switch circuit) Tr13 of the pixel drive circuit DC is in an initial status to maintain the initial characteristic in which substantially no variation of the element characteristic due to the driving history is caused and when the a voltage obtained by deducting the unit voltage Vunit from the detection voltage Vdet is applied to the data line Ld. As described above, when the unit voltage Vunit is a voltage difference between the drain/source voltages Vds of neighboring gradations, the current value of the current Ids flowing between the drain and the source of the drive transistor Tr13 in an initial characteristic in which a gradation voltage lower by one gradation than the detection voltage Vdet is applied to the data line Ld is the expected current value Iref.

The expected current value Iref may be memorized in a memory provided in the current comparison section 145 or the data driver 140 for example or also may be supplied from the system controller 150 or the like to be temporarily stored in a register provided in the data driver 140 for example. In the writing operation, the compensated gradation voltage Vpix generated by the voltage adjustment section 144 is applied via the data line Ld to the display pixel PIX. However, the writing operation does not perform the measurement of a detected current or a comparison processing with an expected. Thus, a structure for bypassing the current comparison section 145 in the writing operation for example also may be additionally provided.

In the compensated data acquisition operation performed prior to an operation for writing display data to the respective display pixels PIX arranged in the display panel 110 (compensated gradation voltage Vpix), the frame memory 146 sequentially acquires, as compensated data, the offset setting value Mine of the display pixels PIX for one row set in the offset voltage generation section 143 provided in each column via the shift register/data register section 141 to store the data for the respective display pixels PIX for one screen of a display panel (one frame) into individual regions. In the writing operation, the frame memory 146 sequentially outputs the compensated data for the respective display pixels PIX for one row via the shift register/data register section to the offset voltage generation section 143.

(System Controller)

The system controller 150 generates a selection control signal, a power source control signal, and a data control signal for controlling an operation status to output the signals to the selection driver 120, the power source driver 130, and the data driver 140 to operate the respective drivers at a predetermined timing to generate the selection signal Ssel, the power source voltage Vcc, the detection voltage Vdet, and the compensated gradation voltage Vpix having predetermined voltage level to output the voltages to perform a series of driving control operations (the compensated data acquisition operation, the writing operation, the holding operation, and the light-emitting operation) to the respective display pixels PIX (pixel drive circuit DC) to display the predetermined image information based on a video signal on the display panel 110.

(Display Signal Generation Circuit)

The display signal generation circuit 160 extracts a brightness/gradation signal component from a video signal supplied from the outside of the display apparatus 100 for example. Then, the display signal generation circuit 160 prepares, with regards to one row of the display panel 110, the brightness/gradation signal component as display data (brightness/gradation data) comprising a digital signal to supply the data to the data driver 140. When the above video signal comprises a timing signal component specifying a timing at which image information is displayed as in a television broadcasting signal (composite video signal), the display signal generation circuit 160 also may include, in addition to a function to extract the above brightness/gradation signal component, a function to extract a timing signal component to supply the component to the system controller 150. In this case, the system controller 150 generates, based on the timing signal supplied from the display signal generation circuit 160, the respective control signals individually supplied to the selection driver 120, the power source driver 130, and the data driver 140.

<Drive Method of Display Apparatus>

Next, a drive method of the display apparatus in this embodiment will be described. A driving control operation for the display apparatus 100 according to this embodiment mainly comprises: a compensated data acquisition operation for detecting the offset voltage Vofst (more particularly, detection voltage Vdet and the detected current Idet) corresponding to a variation in the element characteristic (threshold voltage) of the transistor Tr13 (drive transistor) for driving the light emission by the respective display pixels PIX arranged in the display panel 110 (pixel drive circuit DC) to memorize, as compensated data, an offset setting value (specific value) for generating the offset voltage Vofst with regards to the respective display pixels PIX into the frame memory 146; and a display driving operation for compensating the original gradation voltage Vorg in accordance with the display data based on the compensated data acquired for the respective display pixels PIX to write the data as the compensated gradation voltage Vpix into the respective display pixels PIX so that the data is held as voltage components to supply, based on the voltage components, the drive current Iem having a current value in accordance with display data for which an influence by the variation of the element characteristic of the transistor Tr13 is compensated to the organic EL element OLED to allow the organic EL element OLED to emit light with predetermined brightness and gradation. These compensated data acquisition operation and display driving operation are performed based on various control signals supplied from the system controller 150. The following section will specifically describe the respective operations.

(Compensated Data Acquisition Operation)

Figure 11:
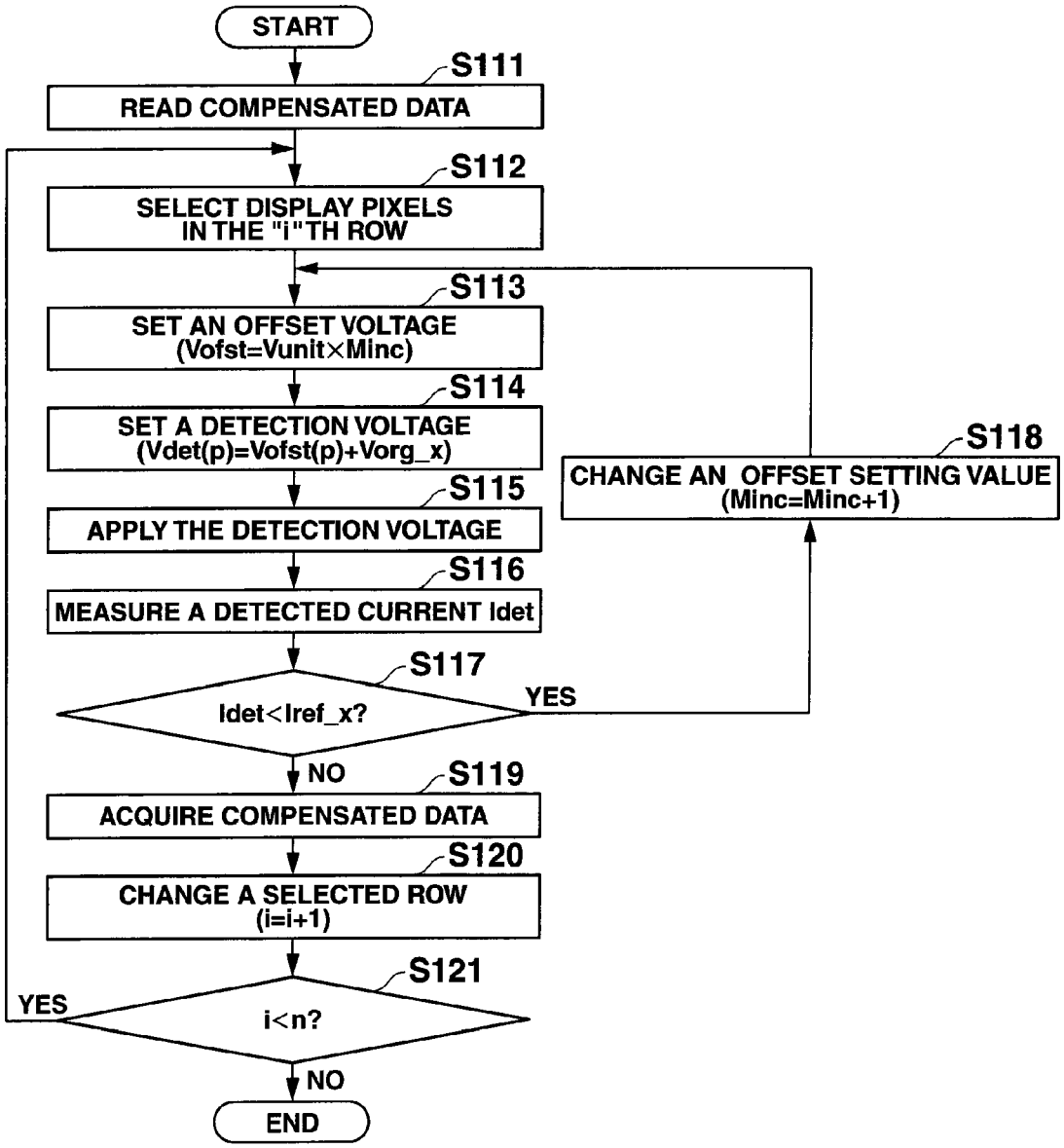
FIG. 11 is a flowchart illustrating an example of a compensated data acquisition operation in the display apparatus according to this embodiment.

FIG. 11 is a flowchart illustrating an example of the compensated data acquisition operation in the display apparatus according to this embodiment.

Figure 12:
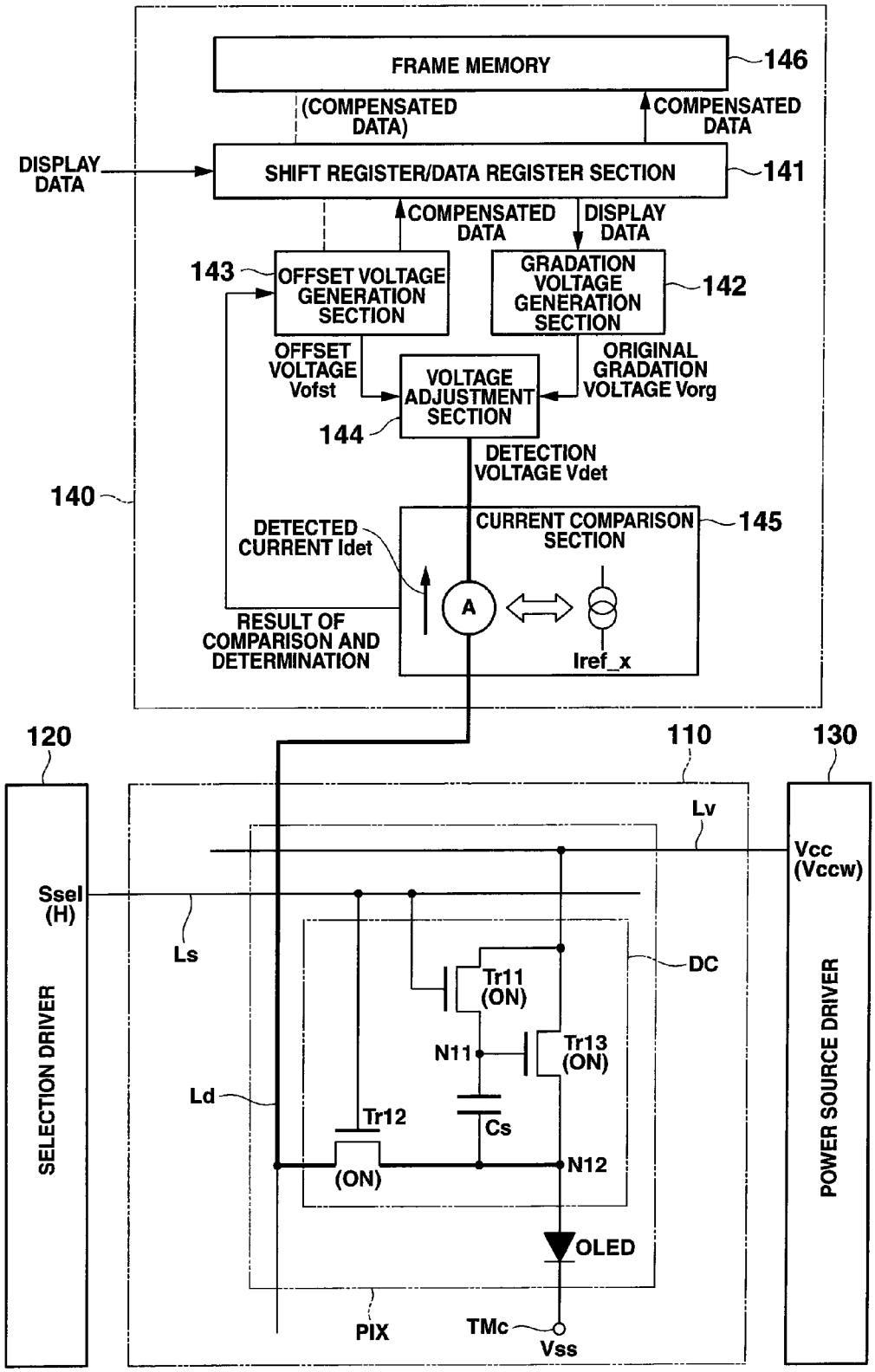
FIG. 12 is a conceptual diagram illustrating the compensated data acquisition operation in the display apparatus according to this embodiment.

FIG. 12 is a conceptual diagram illustrating the compensated data acquisition operation in the display apparatus according to this embodiment.

The compensated data acquisition operation according to this embodiment (offset voltage detection operation; the first Step) firstly allows, as shown in FIG. 11, the offset voltage generation section 143 to read the offset setting value Mine (Min=0 in an initial stage) of the display pixel PIX of the "i"th display pixel PIX ("i" is a positive integer for which $1 \leqq i \leqq n$ is established) from the frame memory 146 via the shift register/data register section 141 (Step S111). Thereafter, as in the above-described writing operation of the pixel drive circuit DCx, the power source voltage lines Lv connected to the ith display pixel PIX (a positive integer for which $1 \leqq i \leqq n$ is established) (the power source voltage lines Lv commonly connected to all display pixels PIX in a group including the ith row in this embodiment) are applied by the power source driver 130 with the power source voltage Vcc (=Vccw≦reference voltage Vss; the first voltage) having a low potential as a writing operation level. During the application, the selection driver 120 applies the selection signal Ssel of a selected level (high level) to the ith selection line Ls to set the ith display pixel PIX to a selected status (Step S112).

As s result, the transistor Tr11 provided in the pixel drive circuit DC of the display pixels PIX in the first row is in an ON operation to set the transistor Tr13 (drive transistor) to a diode-connected status. At the same time, the power source voltage Vcc (=Vccw) is applied to the drain terminal and gate terminal of the transistor Tr13 (contact point N11; one end of the capacitor Cs) and the transistor Tr12 is also in an ON status to electrically connect the source terminal of the transistor Tr13 (the contact point N12; the other end of the capacitor Cs) to the data line Ld of each column.

Next, based on the offset setting value Mine inputted to the offset voltage generation section 143, the offset voltage Vofst as described in the above formula (1) (Step S113). The offset voltage Vofst generated by the offset voltage generation section 143 is calculated by multiplying the unit voltage Vunit with the offset setting value Mine (Vofst=Vunit×Minc). Thus, when there is no threshold value shift at an initial stage, the frame memory 146 outputs the offset setting value Minc of 0 (zero) and the offset voltage Vofst has an initial value of 0V.

The voltage adjustment section 144 adds the offset voltage Vofst outputted from the offset voltage generation section 143 to the original gradation voltage Vorg_x corresponding to the above predetermined gradation (gradation x) outputted from the gradation voltage generation section 142 based on the display data as in the following formula (13) to generate the detection voltage Vdet(p) (Step S114). Then, the voltage adjustment section 144 applies, as shown in FIG. 12, the detection voltage Vdet(p) via the current comparison section 145 to the respective data lines Ld arranged in the column direction of the display panel 110 (Step S115).

$$Vdet(p)=Vofst(p)+vorg_x \tag{13}$$

In this formula, "p" in Vdet(p) and Vofst(p) represents the time of offset settings in the compensated data acquisition operation and a natural number and sequentially increases with the change of an offset setting value (which will be described later). Thus, Vofst(p) is a negative variable that has an increasing absolute value with an increase of "p". Vdet(p) is a negative variable that has an increasing absolute value with an increase of a value of vofst(p) (i.e., with an increase of "p"). As a result, the source terminal (contact point N12) of the transistor Tr13 is applied with the detection voltage Vdet (=Vofst+Vorg_x) via the transistor Tr12 and the gate terminal (contact point N11) and the drain terminal of the transistor Tr13 are applied with the power source voltage Vccw having a low potential. Thus, a voltage component (Ivdet−Vccwl) corresponding to the difference between the detection voltage Vdet and the power source voltage Vccw is applied between the gate and the source of the transistor Tr13 (both ends of the capacitor Cs) to cause the transistor Tr13 to be in an ON operation.

The original gradation voltage Vorg_x outputted from the gradation voltage generation section 142 is a designed voltage value (theoretical value) by which the display pixel PIX (organic EL element OLED) for which the offset voltage Vofst corresponding to a variation of the threshold voltage Vth of the transistor Tr13 is to be detected can emit light with arbitrary brightness and gradation (e.g., x gradation). The detection voltage Vdet added with the offset voltage Vofst is set to have a voltage value having a negative polarity to the power source voltage Vccw having a writing operation level (low level) applied from the power source driver 130 to the display pixel PIX ($Vdet=Vofst+Vorg_x<Vccw \leqq 0$). Display data for specifying the gradation (gradation x) at this original gradation voltage Vorg_x may be previously set in the gradation voltage generation section 142 or also may be inputted from the outside of the data driver 140.

Next, while the detection voltage Vdet being applied from the voltage adjustment section 144 to the data line Ld, an ammeter provided in the current comparison section 145 is used to measure the current value of the detected current Idet flowing in the data line Ld (Step S116). Then, the display pixel PIX has a voltage relation according to which the detection voltage Vdet having a lower potential than that of the power source voltage Vccw applied to the power source voltage line Lv is applied to the data line Ld and thus the detected current Idet flows from the display pixel PIX via the data line Ld to the data driver 140 (voltage adjustment section 144).

Next, the current comparison section 145 performs a current comparison processing to compare the current value of the detected current Idet measured by the ammeter with a design value of the current flowing in the data line Ld (current value of expected current Iref) when the display pixel PIX (organic EL element OLED) is caused to emit light with the above arbitrary brightness and gradation (gradation x). Then, the current comparison section 145 outputs the result of comparison and determination (magnitude relation) to the offset voltage generation section 143 (Step S117). The comparison processing by the current comparison section 145 between the detected current Idet and the expected current Iref at a gradation x determines whether the detected current Idet is smaller than the expected current Iref (Idet<Iref) or not.

When the detected current Idet is smaller than the expected current IrefX and when the detection voltage Vdet(p) is directly applied as the compensated gradation voltage Vpix to the data line Ld in a writing operation, an influence by the shift of the threshold value of the V-I characteristic line SPw2 of the transistor Tr12 and the transistor Tr13 may cause current having a lower gradation than a desirably displayed gradation to flow between the drain and the source of the transistor Tr13.

Thus, when the detected current Idet is smaller than the expected current Iref_X, the current comparison section 145 outputs, to the counter of the offset voltage generation section 143, the result of comparison and determination for increasing a counter value of the offset voltage generation section 143 by one (e.g., positive voltage signal).

When the counter of the offset voltage generation section 143 increases its count by one, the offset voltage generation section 143 adds one to the value of the offset setting value Mine (Step S118) to repeat Step S113 based on the added offset setting value Mine to generate Vofst(p+1). Thus, Vofst (p+1) has a negative value satisfying the following formula (14).

$$Vofst(p+1)=Vofst(p)+V\text{unit} \quad (14)$$

Thereafter, steps after Step S114 are followed by Step S117 that is repeated until the detected current Idet is higher than the expected current Ire_x.

When Step S117 finds that the detected current Idet is higher than the expected current Iref_X, the result of comparison and determination for not increasing the counter value of the counter of the offset voltage generation section 143 (e.g., negative voltage signal) is outputted to the counter of the offset voltage generation section 143.

When the counter acquires the above the result of comparison and determination (negative voltage signal), the offset voltage generation section 143 assumes that the detection voltage Vdet(p) has compensated the shift of the threshold potential value based on the V-I characteristic line SPw2 of the transistor Tr12 and the transistor Tr13. Then, the offset voltage generation section 143 outputs then gradation offset setting value Mine as compensated data to the shift register/data register section 141 so that then detection voltage Vdet (p) is used as the compensated gradation voltage Vpix applied to the data line Ld. The shift register/data register section 141 transfers the gradation offset setting value Mine as compensated data for each column to the frame memory, thereby completing the acquisition of compensated data (Step S119).

It is noted that the frame memory 146 outputs accumulated gradation offset setting values Mine to the offset voltage generation section 143 in both of the compensated data acquisition operation and the writing operation.

Next, after the acquisition of compensated data to the display pixel PIX of the "i"th row, in order to perform the above-described series of processing operations to the display pixels PIX in the next row (i+1th row), a processing for incrementing the variable "i" for specifying a row (i=i+1) (Step S120). Then, whether the variable "i" subjected to the increment processing is smaller than the total number of rows "n" set in the display panel 110 (i<n) or not is determined (Step S121).

When the comparison in Step S121 with a variable for specifying a row determines that the variable "i" is smaller than the number of rows "n" (i<n), the above-described processing of Step S112 to S121 are repeated until Step S121 determines that the variable "i" is equal to the number of rows "n" (i=n).

When Step S121 determines that the variable "i" is equal to the number of rows "n" (i=n), the compensated data acquisition operation to the display pixels PIX of the respective rows is performed for all rows in the display panel 110. Then, it is assumed that compensated data for the respective display pixels PIX are individually stored in predetermined memorization regions of the frame memory 146, thereby completing the above-described series of compensated data acquisition operations.

In the period of this compensated data acquisition operation, the respective terminals have potentials satisfying the above-described relations (3) to (10). Thus, no current flows in the organic EL element OLED and thus the organic EL element OLED does not perform a light-emitting operation.

As described above, in the case of the compensated data acquisition operation, the detection Idet flowing when the data line Ld is applied with the detection voltage Vdet is measured as shown in FIG. 12. Then, when the drain/source current Ids of the transistor Tr13 at the gradation x based on the V-I characteristic line SPw in the initial status is assumed as an expected value, the offset voltage Vofst for flowing, in a writing operation, the drain/source current Ids of the transistor Tr13 close to this expected value is set to set the gradation offset setting value Mine at this offset voltage Vofst as compensated data in the frame memory 146.

Specifically, the offset voltage Vofst(p) having a negative potential in accordance with the gradation offset setting value Minc from the offset voltage generation section 143 and the original gradation voltage Vorg_x having a negative potential at the gradation x from the gradation voltage generation section 142 are added by the voltage adjustment section 144 based on the formula (13) to generate the detection voltage Vdet(p). When the detection voltage Vdet(p) is compensated in a writing operation so as to have a value closer to the drain/source current Ids_x of the expected value of the transistor Tr13, the gradation offset setting value Mine of this detection voltage Vdet(p) is stored in the frame memory 146 so that the potential of this detection voltage Vdet(p) can be handled as the compensated gradation voltage Vpix applied to the data line Ld.

Although the above section has described that the original gradation voltage Vorg_x is generated by the gradation voltage generation section 142 based on display data of the respective display pixels PIX supplied from the display signal generation circuit 160, the original gradation voltage Vorg_x for adjustment also may be a fixed value and may be outputted from the gradation voltage generation section 142 without using display data supplied from the display signal generation circuit 160. In this case, the original gradation voltage Vorg_x for adjustment preferably has a potential as described above by which such current is obtained that causes the expected current IrefX to cause the organic EL element OLED in the light-emitting operation period to emit light with the highest brightness and gradation (or a gradation close to the highest gradation). In the above embodiment, the display apparatus 100 is a current drawing-type display apparatus in which the drain/source current Ids of the transistor Tr13 flows from the display transistor Tr13 to the data driver 140 and thus the unit voltage Vunit has a negative value. However, in the case of a current push-type display apparatus in which the drain/source current Ids of a transistor serially connected to the organic EL element OLED flows from a data driver to the transistor, the unit voltage Vunit is set to have a positive value.

(Display Driving Operation)

Next, a display driving operation in the display apparatus according to this embodiment will be described.

Figure 13:
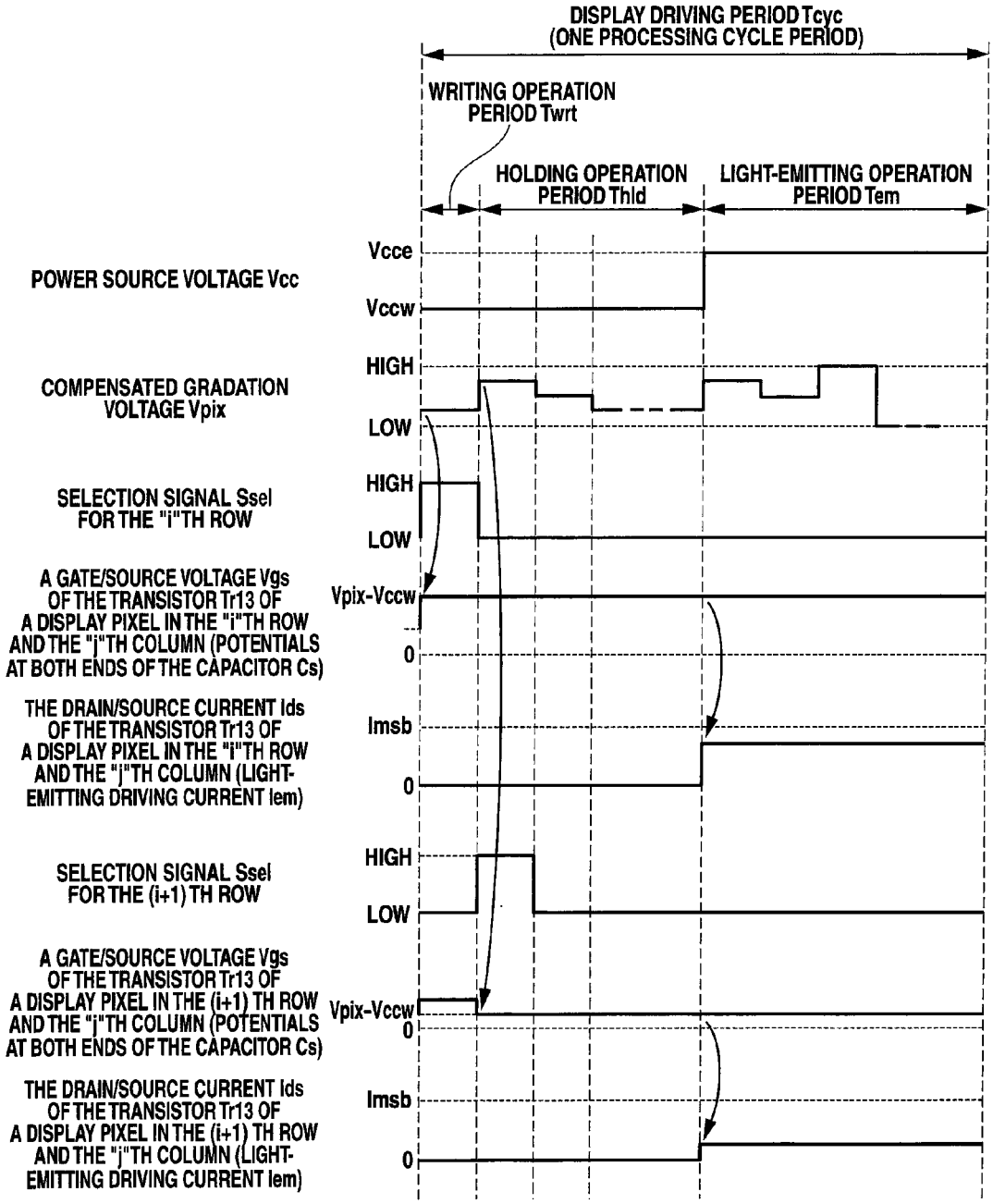
FIG. 13 is a timing chart illustrating an example of a display drive operation in the display apparatus according to this embodiment.

FIG. 13 is a timing chart illustrating an example of the display driving operation in the display apparatus according to this embodiment.

For convenience of description, such a timing chart is shown according to which, among the display pixels PIX arranged in the display panel 110 in a matrix manner, the display pixels PIX in ith row and jth column and (i+1) th row and jth column (i is a positive integer for which $1 \leqq j \leqq m$ is established and j is a positive integer for which $1 \leqq j \leqq m$ is established) are used for a light-emitting operation with a brightness and a gradation in accordance with display data.

Figure 14:
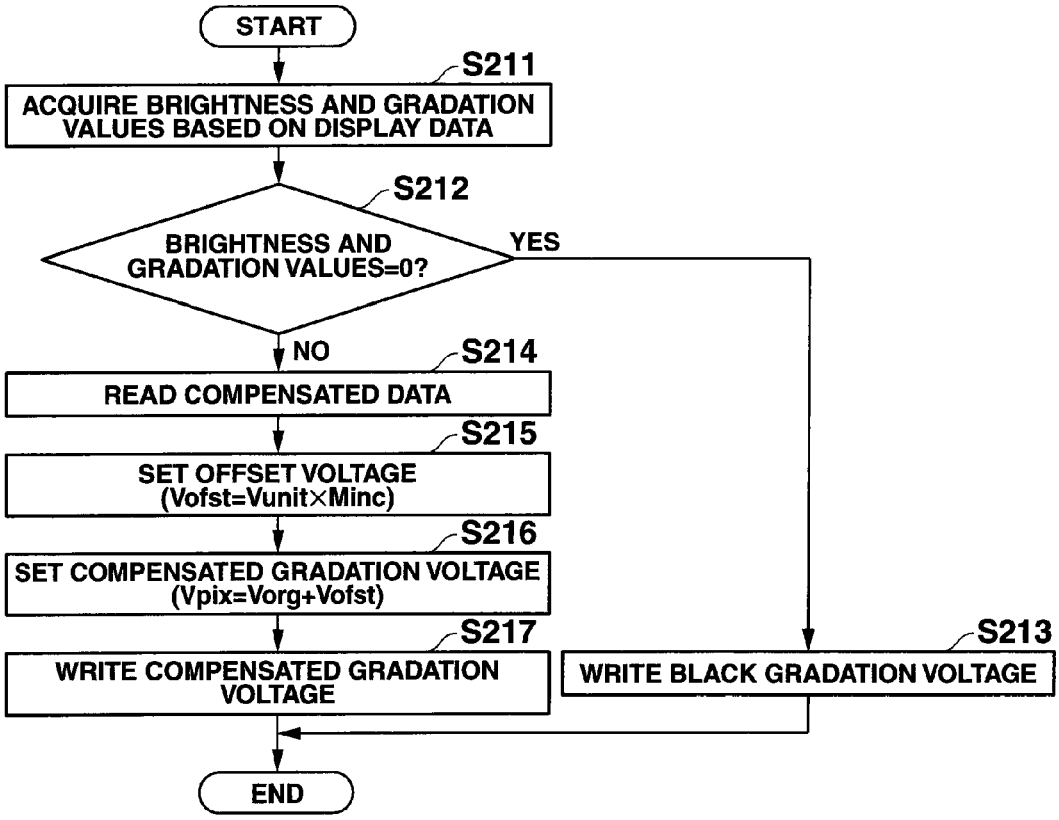
FIG. 14 is a flowchart illustrating an example of a writing operation in the display apparatus according to this embodiment.

FIG. 14 is a flowchart illustrating an example of a writing operation in the display apparatus according to this embodiment.

Figure 15:
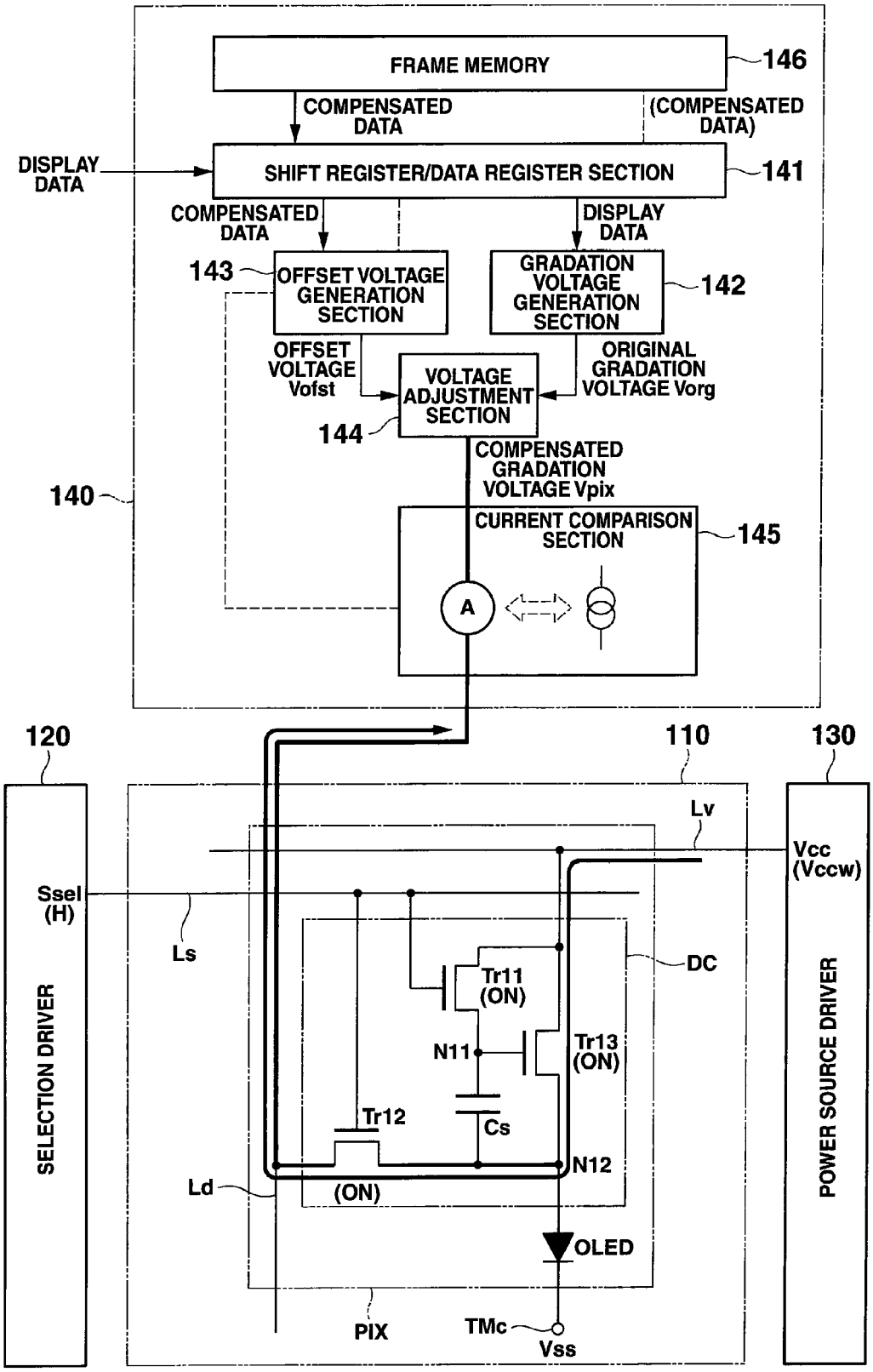
FIG. 15 is a conceptual diagram illustrating a writing operation in the display apparatus according to this embodiment.

FIG. 15 is a conceptual diagram illustrating a writing operation in the display apparatus according to this embodiment.

Figure 16:
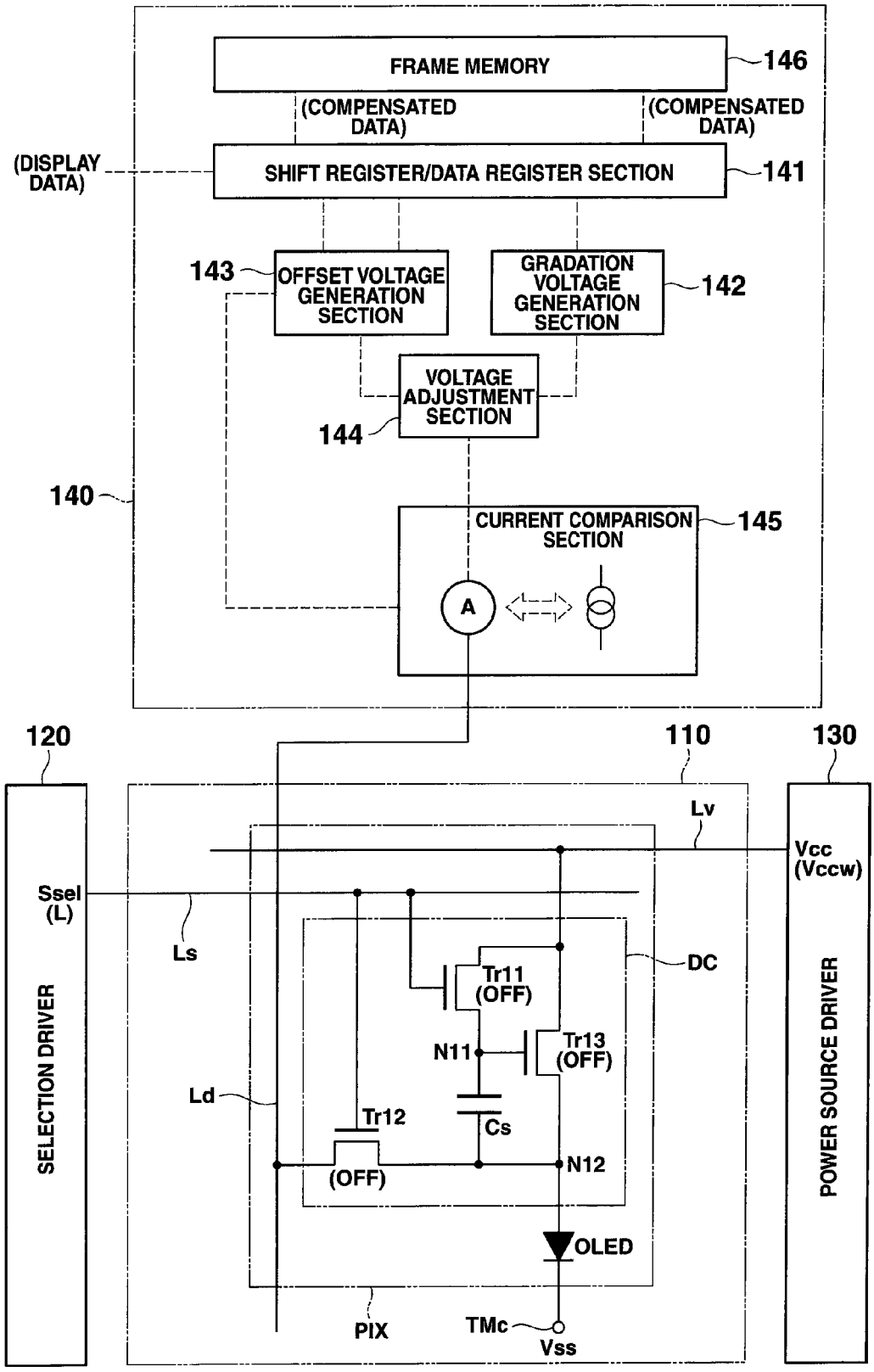
FIG. 16 is a conceptual diagram illustrating a holding operation in the display apparatus according to this embodiment.

FIG. 16 is a conceptual diagram illustrating a holding operation in the display apparatus according to this embodiment.

Figure 17:
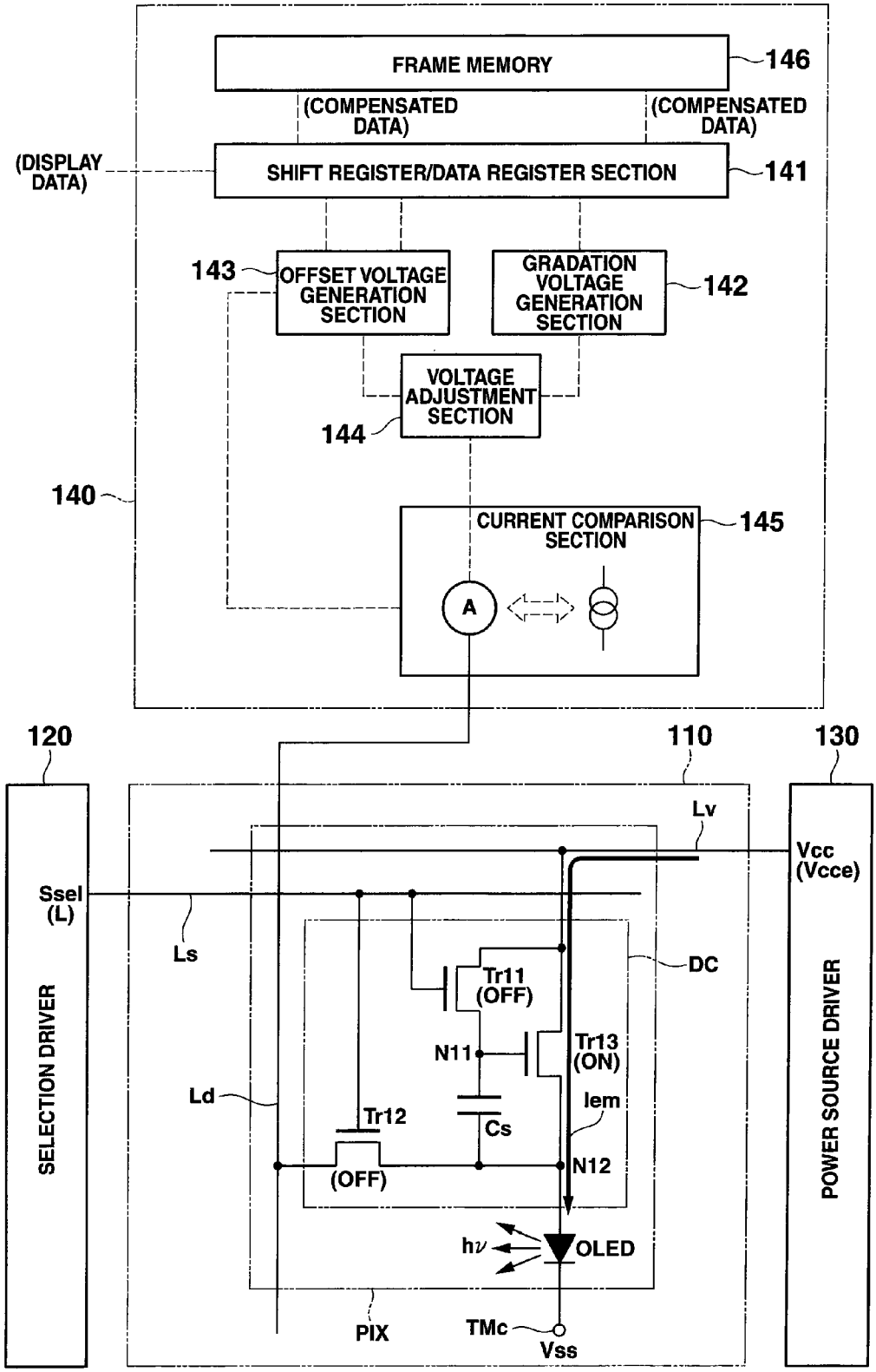
FIG. 17 is a conceptual diagram illustrating a light-emitting operation in the display apparatus according to this embodiment.

FIG. 17 is a conceptual diagram illustrating a light-emitting operation in the display apparatus according to this embodiment.

The display driving operation of the display apparatus according to this embodiment 100 is set to perform, as in the above-described drive method of the pixel drive circuit DCx, a writing operation (writing operation period Twrt) as shown in FIG. 13 for example to add, within a predetermined display driving period (one processing cycle period) Tcyc, at least the original gradation voltage Vorg in accordance with the display data of the respective display pixels PIX supplied from display signal generation circuit 160 to the offset voltage Vofst generated based on the above compensated data stored in the frame memory 146 as the offset setting value Mine to generate the compensated gradation voltage Vpix to supply the compensated gradation voltage Vpix via the respective data lines Ld to the respective display pixels PIX; a holding operation (holding operation period Thld) to charge, in the capacitor Cs, a voltage component in accordance with the compensated gradation voltage Vpix written by the writing operation between the gate and the source of the transistor Tr13 provided in the pixel drive circuit DC of the transistor Tr13 to hold the voltage component; and a light-emitting operation (light-emitting operation period Tem) to flow, based on the voltage component held by the holding operation in the capacitor Cs, the drive current Iem having a current value in accordance with the display data into the organic EL element OLED to allow the organic EL element OLED to emit light with predetermined brightness and gradation ($Tcyc \geqq Twrt+Thld+Tem$).

One processing cycle period applied to the display driving period Tcyc according to this embodiment is set, for example, to a period required for the display pixel PIX to display image information for one pixel of an image of one frame. Specifically, when the display panel 110 in which a plurality of display pixels PIX are arranged in the row direction and column direction in a matrix-like manner displays an image of one frame, the above one processing cycle period Tcyc is set to a period required for the display pixels PIX in one row to display an image of one row of an image of one frame.

(Writing Operation)

In the writing operation (writing operation period Twrt), the power source voltage line Lv connected to the display pixel PIX in the "i"th row is applied, as shown in FIG. 13 and as in the above-described writing operation of the pixel drive circuit DCx, with the power source voltage Vcc ($=Vccw \leqq Vss$: the first voltage) of the writing operation level (0V or negative voltage). During this application, the selection line Ls in the "i"th row is applied with the selection signal Ssel of the selected level (high level) to set the display pixels PIX in the "i"th row to a selected status. As a result, the transistor Tr11 (holding transistor) and the transistor Tr12 provided in the pixel drive circuit DC are allowed to have an ON operation to set the transistor Tr13 (drive transistor) to a diode-connected status, to apply the power source voltage Vcc to the drain terminal and gate terminal of the transistor Tr13, and to connect the source terminal to the data line Ld.

In synchronization with this timing, the data line Ld is applied with the compensated gradation voltage Vpix in accordance with the display data. The compensated gradation signal Vpix is generated based on a series of processing operations (gradation voltage compensation operations) as shown in FIG. 14 for example.

Specifically, as shown in FIG. 14, based on the display data supplied from the display signal generation circuit 160, brightness and gradation values of the display pixel PIX to be subjected to a writing operation are firstly acquired (Step S211) to determine whether the brightness and gradation values are "0" or not (Step S212). When the gradation value determination operation in Step S212 finds the brightness and gradation values of "0", a predetermined gradation voltage (black gradation voltage) Vzero for performing the nonluminescence operation (or the black display operation) is outputted from the gradation voltage generation section 142 and the gradation voltage Vzero is directly applied by the voltage adjustment section 144 to the data line Ld without being added with the offset voltage Vofst (i.e., without performing a compensation processing to a variation of the threshold voltage of the transistor Tr13) (Step S213). The gradation voltage Vzero for a nonluminescence operation is set to have a relation by which the voltage Vgs ($\approx Vccw-Vzero$) applied between the gate and the source of the diode-connected transistor Tr13 is lower than the threshold voltage Vth of the transistor Tr13 ($Vgs<Vth$) ($-Vzero<Vth-Vccw$). In order to suppress the shifts of the threshold values of the transistor Tr12 and the transistor Tr13, a relation of $Vzero=Vccw$ is preferably established.

When the Step S212 finds the brightness and a gradation value other than "0", the gradation voltage generation section 142 generates the original gradation voltage Vorg having a voltage value in accordance with the brightness and gradation values (display data) to output the original gradation voltage Vorg (the second step). At the same time, compensated data stored to correspond to the respective display pixels PIX in the row is sequentially read from the frame memory 146 via the shift register/data register section 141 (Step S214). Then, the compensated data is outputted to the offset voltage generation section 143 provided for each data line Ld of each column to multiply the compensated data as the offset setting value Mine with the unit voltage Vunit to generate the offset voltage Vofst ($=Vunit \times Minc$) in accordance with the change amount of the threshold voltage of the transistor Tr13 of the respective display pixels PIX (pixel drive circuit DC) (Step S215; the third step).

Then, as shown in FIG. 15, the voltage adjustment section 144 adds the original gradation voltage Vorg having a negative potential outputted from the gradation voltage generation section 142 to the offset voltage Vofst having a negative potential outputted from the offset voltage generation section 143 so as to satisfy the formula (12) to generate the compensated gradation voltage Vpix having a negative potential (Step S216) to subsequently apply the compensated gradation voltage Vpix to the data line Ld (Step S217). The compensated gradation voltage Vpix generated by the voltage adjustment section 144 is set to have a voltage amplitude of a negative potential relative to that of the power source voltage Vcc ($=Vccw$) of a writing operation level (low potential) applied from the power source driver 130 to the power source voltage line Lv. The compensated gradation voltage Vpix declines to a negative potential with an incased of a gradation (the voltage amplitude has an increasing absolute value).

As a result, the source terminal (contact point N12) of the transistor Tr13 is added with the compensated gradation voltage Vpix compensated by being added with the offset voltage Vofst in accordance with the variation of the threshold voltage Vth of the transistor Tr13. Thus, the compensated voltage Vgs is written and set between the gate and the source of the transistor Tr13 (both ends of the capacitor Cs) (the fourth step). The writing operation as described above does not flow current in accordance with display data into the gate terminal and source terminal of the transistor Tr13 to set a voltage component but to directly apply a desired voltage to the gate terminal and source terminal of the transistor Tr13. Thus, potentials of the respective terminals and contact points can be set to in a desired status.

In this writing operation period Twrt, the voltage value of the compensated gradation voltage Vpix applied to the contact point N12 at the anode terminal of the organic EL element OLED is set to be lower than the reference voltage Vss applied to the cathode terminal TMc (i.e., the organic EL element OLED is set to be in a reverse bias status). Thus, no current flows in the organic EL element OLED to prevent the organic EL element OLED from emitting light.

(Holding Operation)

Next, the writing operation period Twrt as described above is followed by the holding operation (holding operation period Thld) in which the selection line Ls in the "i"th row is applied, as shown in FIG. 13, with the selection signal Ssel having a not-selected level (low level). As a result, as shown in FIG. 16, the transistors Tr11 and Tr12 are in an OFF operation to cancel the diode-connected status of the transistor Tr13 and the application of the compensated gradation voltage Vpix to the source terminal of the transistor Tr13 (contact point N12) is blocked to charge the capacitor Cs with the voltage component (|Vpix−Vccw|) having been charged between the gate and the source of the transistor Tr13.

At this timing, a writing operation is performed in which the selection driver 120 applies the selection signal Ssel of a selected level (high level) to the selection line Ls in the (i+1)th row to write, as described above, the compensated gradation voltage Vpix into the (i+1)th display pixel PIX. As described above, during the holding operation period Thld of the display pixels PIX in the "i"th line, the holding operation is continued until the display pixels PIX in other lines are sequentially written with a voltage component in accordance with display data (compensated gradation voltage Vpix).

(Light-Emitting Operation)

Next, the writing operation period Twrt and the holding operation period Thld are followed by a light-emitting operation (light-emitting operation period Tem; the fifth step) in which, as shown in FIG. 13, the selection lines Ls of the respective rows are applied with the selection signal Ssel of the not-selected level (low level). During the application, the power source voltage line Lv connected to the display pixels PIX in the respective rows are applied with the power source voltage having a high potential (positive voltage) as a light-emitting operation level (the second voltage) Vcc (=Vcce>0V: the second voltage).

The power source voltage Vcc (=Vcce) having a high potential applied to the power source voltage line Lv is set, as shown in FIG. 7 and FIG. 8, to be higher than the sum of the saturated voltage (pinch-off voltage Vpo) of transistor Tr13 and the drive voltage (Voled) of the organic EL element OLED. Thus, the transistor Tr13 operates in a saturated region. The anode side of the organic EL element OLED (contact point N12) is applied with a positive voltage in accordance with the voltage component (|Vpix−Vccw|) written and set by the above writing operation between the gate and the source of the transistor Tr13. The cathode terminal TMc on the other hand is applied with the reference voltage Vss (e.g., ground potential) to sequentially set the organic EL element OLED in a forward bias status. Thus, as shown in FIG. 17, the drive current Iem having a current value in accordance with display data (strictly, compensated gradation voltage; compensated gradation voltage Vpix) (current Ids between the drain and the source of the transistor Tr13) flows from the power source voltage line Lv via the transistor Tr13 into the organic EL element OLED. Thus, the organic EL element OLED emits light with predetermined brightness and gradation.

This light-emitting operation is continuously performed until the power source driver 130 applies the power source voltage Vcc (=Vccw) having a writing operation level (negative voltage) and the next display driving period (one processing cycle period) Tcyc is started.

According to the series of display driving operations as described above, as shown in FIG. 13, the display pixels PIX arranged in the respective rows of the display panel 110 are applied with the power source voltage of a writing operation level Vcc (Vccw). During the application, each row is written with the compensated gradation voltage Vpix to sequentially perform an operation to hold the predetermined voltage component (|Vpix−Vccw|). Then, the display pixels PIX in a row already subjected to the writing operation and holding operation can be applied with the power source voltage Vcc (=Vcce) at a light-emitting operation level to allow the display pixels PIX in the row to emit light.

When a driving control (which will be described later) in which the completion of the writing operation to the display pixels PIX in all rows in each group is followed by an operation to allow the display pixels PIX in the group to simultaneously emit light for example, the above-described holding operation is provided between the writing operation and the light-emitting operation. In this case, the holding operation period Thld has a length different for every row. When the driving control as described above is not performed, the holding operation also may be omitted.

In the display apparatus 100 according to this embodiment, as shown in FIG. 9, the display pixels PIX arranged in the display panel 110 are divided to two groups including an upper region and a lower region of the display panel 110 so that the respective groups are applied, via the individual branched power source voltage lines Lv, with independent power source voltages Vcc. Thus, the display pixels PIX in a plurality of rows included in the respective groups can emit light simultaneously. The following section will describe a specific driving control operation in this case.

Figure 18:
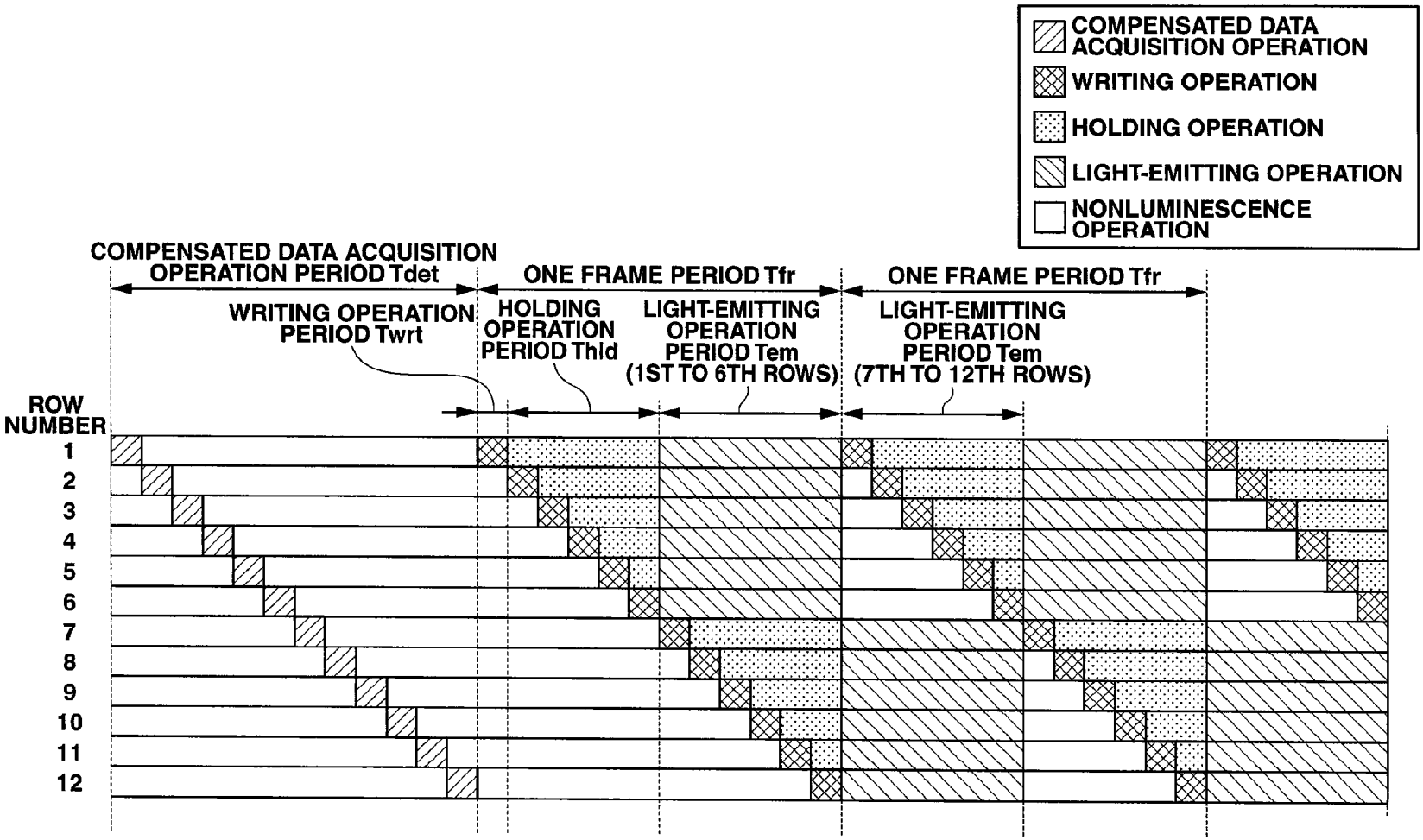
FIG. 18 is an operation timing diagram schematically illustrating a specific example of a drive method of the display apparatus according to this embodiment.

FIG. 18 is an operation timing diagram schematically illustrating a specific example of a drive method of the display apparatus according to this embodiment.

For convenience of description, FIG. 18 illustrates an operation timing diagram for a case where the display panel comprises display pixels arranged in 12 rows (n=12; the $1^{st}$ to $12^{th}$ rows) and the $1^{st}$ to $6^{th}$ rows (which correspond to the above-described upper region) and the $7^{th}$ to the $12^{th}$ rows (which correspond to the above-described lower region) are recognized as two groups.

In the driving control operation in the display apparatus 100 including the display panel 110 shown in FIG. 9, as shown in FIG. 18, all display pixels PIX arranged in the display panel 110 are sequentially subjected to the above-described compensated data acquisition operation for each row with a predetermined timing. After the completion of the compensated data acquisition operation to all rows in the display panel 110 (i.e., after the compensated data acquisition operation period Tdet), the display pixels PIX in each row of the display panel 110 (pixel drive circuit DC) is written, within one frame period Tfr, with the compensated gradation voltage Vpix obtained by adding the original gradation voltage Vorg in accordance with the display data to the offset voltage Vofst corresponding to the variation of the element characteristic of the drive transistor (transistor Tr13) of each display pixel. While an operation for holding the predetermined voltage component (|vpix−Vccw|) is being sequentially repeated for every row, when the above writing operation to the display pixels PIX in the $1^{st}$ to $6^{th}$ rows and the 7th to 12th rows of the previously set groups (organic EL element OLED) is completed, the display driving operation for allowing all display pixels PIX included in the group to simultaneously emit light with a brightness and a gradation in accordance with display data (compensated gradation voltage Vpix) (the display driving period Tcyc shown in FIG. 13) is repeatedly performed to display image information for one screen of the display panel 110.

Specifically, the groups of the display pixels PIX in the $1^{st}$ to $6^{th}$ rows and the $7^{th}$ to $12^{th}$ rows among the display pixels PIX arranged in the display panel 110 are applied, via the power source voltage line Lv commonly connected to the display pixels PIX of the respective groups, the power source voltage Vcc (=Vccw) having a low potential. During this application, the display pixels PIX are sequentially subjected, in an order starting from the display pixels PIX in the first row, to the above compensated data acquisition operation (compensated data acquisition operation period Tdet). With regards to all display pixels PIX arranged in the display panel 110, the compensated data corresponding to the variation of the threshold voltage of the transistor Tr13 (drive transistor) provided in the pixel drive circuit DC are individually stored (or memorized), with regards to the respective display pixels PIX, in predetermined regions of the frame memory 146.

Next, after the completion of the above compensated data acquisition operation period Tdet, a group including the display pixels PIX in the 1st to 6th rows are applied, via the power source voltage line Lv commonly connected to the display pixels PIX of the group, with the power source voltage Vcc (=Vccw) having a low potential. During this application, the display pixels PIX are subjected, in an order starting from the display pixels PIX in the first row, to the above writing operation (writing operation period Twrt) and holding operation (holding operation period Thld). When the writing operation of the display pixels PIX in the $6^{th}$ row is completed, the application is switched so that the power source voltage Vcc (=Vcce) having a high potential is applied via the power source voltage line Lv of the group. As a result, the display pixels PIX in the six rows in the group simultaneously emit light based on a brightness and a gradation based on the display data (compensated gradation voltage Vpix) written in the display pixels PIX. This light-emitting operation is continued until the next writing operation for the display pixels PIX in the first row is started (light-emitting operation period Tem for the $1^{st}$ to $6^{th}$ rows).

When the writing operation to the display pixels PIX in the above the $1^{st}$ to $6^{th}$ rows is completed, a group including the display pixels PIX in the $7^{th}$ to $12^{th}$ rows are applied, via the power source voltage line Lv commonly connected to the display pixels PIX of the group, with the power source voltage Vcc (=Vccw) having a low potential. Then, the display pixels P IX are subjected, in an order starting from the display pixels PIX in the $7^{th}$ row, to the above writing operation (writing operation period Twrt) and the holding operation (holding operation period Thld). When the writing operation to the display pixels PIX in the $12^{th}$ row is completed, the application is switched so that the power source voltage Vcc (=Vcce) having a high potential is applied via the power source voltage line Lv of the group. As a result, the display pixel PIX in the six rows of the group are allowed to emit light with a brightness and a gradation based on the display data (compensated gradation voltage Vpix) written to the respective display pixels PIX (light-emitting operation period Tem for the $7^{th}$ to $12^{th}$ rows). While the display pixels PIX in the $7^{th}$ to $12^{th}$ rows being subjected to the writing operation and the holding operation, an operation is continued in which the display pixels PIX in the 1st to 6th rows are applied, via the power source voltage line Lv, the power source voltage Vcc (=Vcce) having a high potential as described above to allow the display pixels PIX to simultaneously emit light.

As described above, after all display pixels PIX arranged in the display panel 110 are already subjected to the compensated data acquisition operation, the display pixels PIX in the respective rows are sequentially subjected to the writing operation and the holding operation with a predetermined timing. When the display pixels PIX in all rows included in the previously-set groups are already subjected to the writing operation, the display apparatus is driven in a controlled manner so that all display pixels PIX of the group are allowed to simultaneously emit light.

Thus, according to the drive method of the display apparatus (display driving operation) as described above, during a period of one frame period Tfr in which display pixels of the respective rows of a single group are subjected to a writing operation, all display pixels (light-emitting elements of the group can skip a light-emitting operation and can be set to a nonluminescence status (black display status). In the operation timing diagram shown in FIG. 18, the display pixels PIX in 12 rows constituting the display panel 110 are divided to two groups so that the display pixels PIX of the respective groups are controlled to simultaneously emit light with different timings. Thus, a ratio of a black display period by the above nonluminescence operation to one frame period Tfr (black insertion rate) can be set to 50%. In order to allow a human to visually recognize a video without blurring or bleeding and in a clear manner, a black insertion rate of about 30% or more is generally used. Thus, this drive method can realize a display apparatus having a relatively favorably display image quality.

In this embodiment (FIG. 9), a case was shown in which a plurality of display pixels PIX arranged in the display panel 110 were divided to two groups. However, the present invention is not limited to this. The display pixels PIX also may be divided to an arbitrary number of groups (e.g., three groups, four groups) or the display pixels PIX in rows not continuing from one another (e.g., even-numbered rows, odd-numbered rows) also may be decided to groups. By doing this, depending on the number of groups, a light-emitting time and a black display period (black display status) can be arbitrarily set to provide an improved image quality of display.

Alternatively, a plurality of display pixels PIX arranged in the display panel 110 may not divided to groups in contrast with the above section. In this case, power source voltage lines are individually provided (or connected) to the respective rows so that the power source voltages Vice are independently applied with different timings to allow the display pixels PIX in the respective rows to emit light. Alternatively, all display pixels PIX for one screen arranged in the display panel 110 are also may be simultaneously applied with the common power source voltage Vcc to allow all display pixels for one screen of the display panel 110 to simultaneously emit light.

As described above, according to the display apparatus according to this embodiment and the drive method thereof, during the writing operation period of display data, the compensated gradation voltage Vpix specifying a voltage value in accordance with the variation of display data and a variation of an element characteristic (threshold voltage) of a drive transistor is directly applied between the gate and the source of the drive transistor (transistor Tr13). As a result, the predetermined voltage component is held by the capacitor (capacitor Cs). Thus, a voltage writing-type (or voltage application-type) gradation method can be used in which, based on the voltage component, the drive current Iem flowing in the light-emitting element (organic EL element OLED) can be controlled to allow the light-emitting element to emit light with desired brightness and gradation.

Thus, when compared with a current writing-type gradation method in which current in accordance with display data is supplied to perform a writing operation (or in which a voltage component in accordance with display data is held), even when a display panel has a larger size or higher definition or when display with a lower gradation is performed, a gradation signal in accordance with display data (compensated gradation voltage) can be written to the respective display pixels in a fast and secure manner. Thus, display data can be suppressed from being written insufficiently to provide a light-emitting operation with appropriate brightness and gradation in accordance with display data, thus realizing a favorable display image quality.

Furthermore, prior to the display driving operation including the writing operation of display data to display pixels (pixel drive circuit), the holding operation, and the light-emitting operation, compensated data corresponding to a variation of threshold voltages of drive transistors provided in the respective display pixels can be acquired. The compensated data can be used, in the writing operation, to generate gradation signals (compensated gradation voltages) compensated for the respective display pixels to apply the signals. Thus, an influence by the variation of the threshold voltage (shift of a voltage-current characteristic of a drive transistor) can be compensated to allow the respective display pixels (light-emitting elements) to emit light with appropriate brightness and gradation in accordance with the display data. Thus, the respective display pixels can be suppressed from having dispersed light-emitting characteristics, thus providing an improved display image quality.

What is claimed is:

1. A drive method of a display apparatus for displaying image information in accordance with display data, wherein:

the display apparatus includes a display panel in which a plurality of display pixels are arranged, each of the display pixels having a light-emitting element and a pixel drive circuit for controlling a light-emitting status of the light-emitting element, the pixel drive circuit includes at least:

a first switching element which includes a control terminal and a current path, wherein a first end of the current path is applied with a power source voltage, a second end of the current path is connected to a connection contact point to a first end of the light-emitting element, and the connection contact point is applied with a data voltage based on the display data;

a second switching element which includes a control terminal and a current path, wherein a first end of the current path is applied with the power source voltage and a second end of the current path is connected to the control terminal of the first switching element; and a voltage holding element connected between the control terminal of the first switching element and the connection contact point, and the drive method includes:

a writing operation for electrically connecting the control terminal of the first switching element to the first end of the current path of the first switching element through the second switching element, applying the data voltage in accordance with the display data to the second end of the current path of the first switching element, and applying a first power source voltage as the power source voltage to the first end of the current path of the first switching element, wherein the first power source voltage has a potential higher than a potential of the data voltage corresponding to the display data and has a voltage value such that a potential difference between the first end of the current path of the first switching element and the second end of the light-emitting element is equal to or lower than a summed voltage as a sum of a voltage for starting light-emitting of the light-emitting element and a threshold voltage of the first switching element; and a light-emitting operation for electrically blocking the control terminal of the first switching element from the first end of the current path of the first switching element, and applying a second power source voltage as the power source voltage to the first end of the current path of the first switching element to flow a drive current based on a voltage component held by the voltage holding element in the light-emitting element, wherein the second power source voltage has a voltage value for causing the light-emitting element to be in a light-emitting status and is set to a potential different from the first power source voltage.

2. The drive method according to claim 1, further including a holding operation performed at a timing after the writing operation, for causing the current path of the second switching element to be not conductive to electrically block the control terminal of the first switching element from the first end of the current path of the first switching element and setting the power source voltage to the first power source voltage to allow the voltage holding element to hold a voltage component corresponding to a difference between potentials applied to both ends of the current path of the first switching element.

3. The drive method according to claim 1, wherein the light-emitting operation includes an operation for dividing the plurality of display pixels into a plurality of groups each of which includes a plurality of rows and setting the power source voltage applied to the first end of the current path of the first switching element of each of the display pixels in the plurality of rows of the respective groups as the second power source voltage to simultaneously set light-emitting elements of the display pixels in the plurality of rows of the respective groups to a light-emitting status.

4. The drive method according to claim 1, wherein:

the writing operation includes an operation for causing the current path of the second switching element to be conductive to electrically connect the control terminal of the first switching element to the first end of the current path of the first switching element through the current path of the second switching element, and the light-emitting operation includes an operation for causing the current path of the second switching element to be not conductive to cause a status between the control terminal of the first switching element and the first end of the current path of the first switching element to be in a nonconductive status.

5. A display apparatus for displaying image information in accordance with display data, comprising:

a display panel in which a plurality of display pixels are arranged, each of the display pixels having a light-emitting element and a pixel drive circuit for controlling a light-emitting status of the light-emitting element, wherein the pixel drive circuit comprises at least:

a first switching element which includes a control terminal and a current path, wherein a first end of the current path is applied with a power source voltage of one of a first power source voltage and a second power source voltage set to different potentials, a second end of the current path is connected to a connection contact point to a first end of the light-emitting element, and the connection contact point is applied with a data voltage based on the display data;

a second switching element which includes a control terminal and a current path, wherein a first end of the current path is applied with the power source voltage and a second end of the current path is connected to the control terminal of the first switching element; and a voltage holding element connected between the control terminal of the first switching element and the connection contact point, and wherein:

the first power source voltage has a potential higher than a potential of the data voltage corresponding to the display data and has a voltage value such that a potential difference between the first end of the current path of the first switching element and a second end of the light-emitting element is equal to or lower than a summed voltage as a sum of a voltage for starting light-emitting of the light-emitting element and a threshold voltage of the first switching element, the second power source voltage has a voltage value for causing the light-emitting element to be in a light-emitting status, when the data voltage is applied to the second end of the current path of the first switching element, the power source voltage is set to the first power source voltage, and the first end of the current path of the first switching element is connected to the control terminal of the first switching element through the second switching element, and when a drive current based on a voltage held by the voltage holding element flows in the light-emitting element, the power source voltage is set to the second power source voltage, and the first end of the current path of the first switching element is disconnected from the control terminal of the first switching element.

6. The display apparatus according to claim 5, wherein:

the plurality of display pixels are arranged in a vicinity of respective intersection points of a plurality of selection lines and data lines arranged in a row direction and a column direction in the display panel, the display apparatus comprises:

a selection driving section which sequentially applies, with a predetermined timing, a selection signal to the respective plurality of selection lines to sequentially set the display pixels in the respective rows to a selected status;

a data driving section which generates a gradation signal in accordance with the display data to supply the gradation signal to the respective display pixels in a row set to the selected status via the respective data lines; and a power source driving section which supplies the power source voltage, and the second end of the current path of the first switching element is electrically connected to the data line.

7. The display apparatus according to claim 6, wherein the display pixel further comprises a third switching element which includes a control terminal and a current path, wherein a first end of the current path is connected to the data line and a second end of the current path is connected to the connection contact point.

8. The display apparatus according to claim 5, further comprising a connection status control section which controls a conduction status of the current path of the second switching element, wherein the connection status control section provides a control by which:

when the first power source voltage is supplied to the first end of the current path of the first switching element to set the light-emitting element to a no-light-emitting status, the current path of the second switching element is conductive so that the first end of the current path of the first switching element is connected to the control terminal of the first switching element, and when the second power source voltage is supplied to the first end of the current path of the first switching element to set the light-emitting element to a light-emitting status, the current path of the second switching element is not conductive so that the first end of the current path of the first switching element is electrically blocked from the control terminal of the first switching element.

* * * * *